US005317476A

United States Patent [19]

Wallace et al.

[11] Patent Number: 5,317,476

[45] Date of Patent: * May 31, 1994

[54] ELECTRONICALLY MONITORED AND CONTROLLED ELECTROSTATIC DISCHARGE FLOORING SYSTEM

[75] Inventors: William D. Wallace, Fort Worth; Larry E. Smith, Arlington, both of Tex.

[73] Assignee: Loral Vought Systems Corporation, Grand Prairie, Tex.

[ * ] Notice: The portion of the term of this patent subsequent to Aug. 27, 2008 has been disclaimed.

[21] Appl. No.: 39,931

[22] Filed: Mar. 29, 1993

Related U.S. Application Data

[60] Division of Ser. No. 693,959, Apr. 29, 1991, Pat. No. 5,257,159, which is a continuation-in-part of Ser. No. 357,299, May 26, 1989, Pat. No. 5,043,839.

[51] Int. Cl.[5] ..... H05F 3/00

[52] U.S. Cl. ..... 361/220; 361/216; 340/604; 156/273.9

[58] Field of Search ..... 361/212, 216, 220; 340/649, 650, 604, 605; 156/71, 273.9, 297, 299, 300

[56] References Cited

U.S. PATENT DOCUMENTS

| | | | |
|---|---|---|---|
| 3,386,001 | 5/1968 | Slosberg et al. | 361/220 |
| 3,845,353 | 10/1974 | Shirai et al. | 361/220 |
| 4,538,141 | 8/1985 | Feldman | 340/605 |
| 4,649,374 | 3/1987 | Hoigaard | 340/573 |
| 4,885,659 | 12/1989 | Nowell et al. | 361/220 |
| 5,082,712 | 1/1992 | Starp | 428/95 |

*Primary Examiner*—Jeffrey A. Gaffin

*Attorney, Agent, or Firm*—Richards, Medlock & Andrews

[57] ABSTRACT

The flooring structure of this invention controls electrostatic charges. The normal presence of moisture will not affect the floor structure's ability to control electrostatic charges. A moisture detector circuit will, however, indicate the presence of moisture, and can activate means for drying this moisture. The resistance of the flooring structure can be adjusted so that electrostatic charges are dissipated at different rates. Multiple floor structures with different resistance values can be placed side by side. Improper grounding of the flooring structure can be detected and corrected, and the resistance of the flooring structure system can be determined.

18 Claims, 12 Drawing Sheets

ELECTRONICALLY MONITORED AND CONTROLLED ELECTROSTATIC DISCHARGE FLOORING SYSTEM

STATEMENT OF RELATED APPLICATIONS:

This application is a division of copending U.S. application Ser. No. 07/693,959, filed on Apr. 29, 1991 (now U.S. Pat. No. 5,257,159), as a continuation-in-part of U.S. application Ser. No. 357,299, filed May 26, 1989 (now U.S. Pat. No. 5,043,839).

TECHNICAL FIELD OF THE INVENTION

This invention relates in general to electrostatic discharge flooring, and in particular to a moisture resistant electrostatic discharge flooring structure. In one aspect of the invention, the flooring includes a resistance that can be monitored and adjusted, a moisture detector, and means for drying moisture.

BACKGROUND OF THE INVENTION

In many facilities, the normal movement of individuals or equipment across floors can generate electrostatic charges. The conducting or sparking of these electrostatic charges can cause serious problems with equipment and products. Electrostatic charges can also create malfunctions in the internal circuitry of electrical equipment being manufactured or being used in particular facilities. Computer equipment, for example, is prone to malfunctions caused by electrostatic charges. When manufacturing electrical components, especially integrated circuit chips, the avoidance of electrostatic charge is critical because such components are extremely charge sensitive.

In facilities using combustible or explosive materials, sparking can result in dangerous explosions or fires. In hospitals, sparking near an oxygen source can increase the chances of fire. Sparking can also affect charge sensitive electrical equipment being used in care units or operating rooms. Such sparking can even affect the physical condition of a patient being operated on.

Because of the problems and dangers associated with electrostatic charges, various standards have been set requiring-facility floors to meet minimum resistance values and to dissipate electrostatic charges at a minimum rate. For example, the NFPA (National Fire Protection Association) 99 standard requires that the resistance of a floor be more than an average of 25,000 ohms. When measuring the resistance of a floor according to the NFPA 99 standard, a five pound metal weight is placed on the floor, and the resistance from the weight to ground is measured. Several measurements at different points on the floor should be made, and the measurements are averaged to get a value for the floor resistance.

For military purposes, the federal government classifies flooring structures as being conductive, anti-static or dissipative. A flooring structure is considered anti-static if it has a resistance of $10^9$ to $10^{14}$ ohms per square. A flooring structure with this resistance does not create any static electricity but discharges static charges at a very slow rate. Materials that are insulators have resistances of higher than $10^{14}$ ohms per square. Flooring structures with resistances between $10^5$ and $10^9$ ohms per square are considered dissipative. Dissipative flooring structures do not create any electrostatic charges and discharge any existing electrostatic charges at a quick rate. Conductive flooring structures have resistances of less than $10^5$ ohms per square and discharge electrostatic electricity at a very quick rate, but this rate might be so fast as to create a surge capable of damaging electrical components. Anti-static floor structures are effective in some applications, but electrostatic dissipative or discharge flooring structures are useful in most applications.

To eliminate problems associated with electrostatic charges, and to meet the established resistance standards, various floor composition designs have been attempted to prevent the conduction of electrostatic charges and dissipate these electrostatic charges through ground. Although insulative materials prevent the conduction of electrostatic charges, they have been found to be undesirable because they may allow electrostatic charges created by frictional effects to accumulate. See U.S. Pat. No. 2,325,414 by McChesney et al. Surface materials of a hard metallic nature are highly conductive. As discussed above, conductive materials discharge electrostatic charges at a rapid rate, but the rate of discharge might be too rapid, creating a surge. These hard metallic materials are also undesirable since they could produce sparks if struck by another metal object. See U.S. Pat. No. 3,121,825 by Abegg et al. Semi-conductive floor materials were developed to overcome the problems associated with insulating and conducting materials. These semiconductive floor-materials, for example semiconducting rubber or thermoplastic floor tiles containing flakes of conductive material, were designed to have a resistance value such that the material does not accumulate electrostatic charges and discharges electrostatic charges at a sufficient rate.

The principal problem with semiconductive floor materials is that it is difficult to achieve an even distribution of the insulating and conducting material used in fabricating the semiconductive material. This can result in an uneven distribution of electric charges, and varying degrees of electrostatic charge dissipation. To eliminate these problems, conductive screens or meshes have been imbedded in the semiconductive material and attached to a ground terminal. The concept for this type of flooring is that the electrostatic charges travel only short distances in the semiconductive material before they pass through the highly conductive mesh or screen to ground, and since this screen or mesh is uniformly imbedded throughout the semiconductive material, the discharge of the electrostatic charges is uniform throughout.

However, there are several reasons why even these flooring materials fail to adequately discharge the electrostatic charges. Over a period of time, the conductivity and resistance of the semiconductive material, the conductive screen or mesh, and any materials used to affix the layers together or to affix the flooring to ground tend to change. Furthermore, moisture, which is a common occurrence in flooring, not only damages these floors but also causes them to become more conductive than designed.

From the foregoing, it can be seen that a need exists for a flooring structure that dissipates electrostatic charges within adopted standards, and has a resistance that can be monitored and changed to insure that the flooring structure has the desired resistivity. Furthermore, a need exists for an electrostatic discharge controlling flooring structure that is not affected by the first occurrences of moisture, and that contains a monitor for sensing the presence of such moisture. A further need exists for a flooring system made up of multiple flooring structures insulated from each other so that each flooring structure of the flooring system can have a different resistance.

SUMMARY OF THE INVENTION

According to one aspect of the invention, there is provided an electrostatic discharge (ESD) flooring comprising a substantially planar member residing above the ground and a variable resistor connected between the substantially planar member and ground.

According to one aspect of the present invention, a floor structure with different layers is placed on top of a flat rigid surface such as a concrete flooring. The flooring structure includes a bottom layer of interlocking modular cushion tiles. The modular cushion tiles are good insulators, and are moisture resistant. The modular cushion tiles comprise a planar body supported by support members. The spaces between the planar body and the concrete floor created by the spaces between the support members provide space for standing moisture, thereby preventing moisture from seeping towards the upper layers of the flooring structure. Strips of conductive tape are affixed on top of the bottom layer. A layer of conductive epoxy, which acts as an adhesive, is then placed on top of the strips of conductive tape and the areas of the bottom layer not covered with the conductive tape. Semi-conductive tiles are then placed on top of the layer of conductive epoxy after a prescribed time period thus completing an electrostatic discharge controlling tile. The tiles are placed next to each other to create a flooring structure, or each tile, alone, may be considered a flooring structure unto itself. Alternatively, the entire flooring structure may be laid as one tile.

In accordance with other embodiments of the flooring structure, the strips of conductive tape are arranged in a lattice arrangement. The lattice arrangement of the conductive tape and the positioning of the semiconductive tiles are such that the conductive tape overlaps the perimeter of each semiconductive tile on the underside of the semiconductive tiles. The conductive tape is wide enough so that a strip of conductive tape will overlap one side of the perimeter of a semiconductive tile and overlap one side on the perimeter of an adjacent semiconductive tile. A ground wire is attached to the conductive tape at one of the corners of the flooring structure. The ground wire leads to a variable resistance circuit and then to electrical ground. Conductive foam material, which becomes more conductive as it absorbs moisture, is placed under the planar body in the space between the support members. Wires are attached to the two sides of the conductive foam material. These wires lead to a moisture detector circuit. A molding strip is affixed around the periphery of the flooring structure.

According to yet another embodiment of the flooring structure, the conductive tape is arranged and placed so that it does not overlap the sides of the tiles, each tile has its own ground, and each tile is electrically isolated from its neighboring tiles. The resulting flooring structure is strong, resilient, durable, and moisture resistant. The electrical properties of the flooring structure are such that electrostatic charges are dissipated at a desired rate. Electrostatic charges that are present do not accumulate, but are instead drawn into the semiconductive tiles. Then, the charges are drawn from the semiconductive tiles into the more conductive layers containing the conductive epoxy layers and the conductive tape. Finally, the charges are dissipated to ground.

As electrostatic charges are attracted to ground, they are also discharged by the resistance of the materials used to make the flooring structure. A problem is that the resistance of the flooring structure materials tends to be affected by change of temperature, humidity and aging. One aspect of the invention solves this problem by the insertion of a variable resistance between the conductive tape and ground.

According to one aspect of the invention, an ohmmeter is connected across the variable resistance to determine its resistance value. According to another aspect of the invention, an ohmmeter is connected between the conductive material of the flooring structure and the ground wire, to detect continuity to the ground. If the ohmmeter reads the expected resistance value, this indicates that the flooring structure is properly grounded, but if the measured resistance value changes, this indicates that the flooring structure is improperly grounded.

Although the flooring structure works well even in the presence of moisture, moisture might eventually pose problems to the flooring structure. Furthermore, the very presence of moisture under the bottom layer should be investigated. Therefore, one aspect of this invention includes a moisture detector which can be used to detect the presence of moisture. This moisture detector can be used to detect moisture beneath the flooring structure, but can also be used to detect moisture in other applications.

According to one such application, when a predetermined level of moisture is present, the conductive foam material placed under the bottom layer becomes more conductive and completes a circuit which activates an alarm. The circuit can be adjusted so that it is more or less likely to activate the alarm when there is a presence of moisture. Centrifugal blowers, which dry moisture, can be activated when moisture is present under the planar body of the bottom layer. In one embodiment, two centrifugal blowers are installed on opposite ends of the flooring structure. One centrifugal blower blows air under the planar body while the other centrifugal blower sucks in this air and blows the air out of the sides of the centrifugal blower. One blower may also be used.

According to another aspect of the present invention, an electronic control box can be used to consolidate the monitoring and controlling of the variable resistance circuitry and the moisture detector circuitry. In further accordance with the present invention, several flooring structures, which are insulated from each other by the molding strip, can be placed side by side. Each floor structure can be coupled to ground through the respective variable resistor associated with each floor structure. Alternatively, adjacent floor structures can be connected in series through their respective variable resistors so that the overall resistance of one floor structure is increased by the value of the resistance of the adjacent, series-coupled floor structure(s). The resistance of each flooring structure can be set to a different value by adjusting the variable resistor value.

According to a further embodiment of the flooring structure, there is provided an electrostatic charge controlling flooring structure for covering a base surface, comprising a moisture resistant member having one side that is arranged in a substantially planar orientation, an electrically conductive material arranged in a substantially planar orientation and contacting the moisture resistant member, and a semiconductive member arranged in a substantially planar orientation and contacting the electrically conductive material. The moisture resistant member comprises a planar body with support members which raise the planar body above the base surface, the electrically conductive material comprises conductive tape arranged in a lattice, and the flooring structure may further comprise a variable resistance connected between the electrically conductive material and ground.

In certain embodiments, the present invention further comprises a monitor positioned and arranged to measure the resistance between the flooring structure and ground along various current paths. Depending upon the current path selected, different information can be detected by reading the monitor. For instance, one current path reading detects continuity to ground through certain lead wires, while another path reading indicates the resistance value from ground to floor. Such embodiments may further include a moisture sensor positioned and arranged to detect moisture underneath the moisture resistant member, and/or an alarm positioned and arranged to be activated when the moisture sensor detects moisture. In still further embodiments, the flooring structure comprises a moisture dryer positioned and arranged to dry moisture from underneath the planar body of the bottom layer, a monitor positioned and arranged to measure the resistance between the flooring structure and ground, and/or a substantially rigid material of substantially planar shape positioned between the moisture resistant member and the electrically conductive material. The substantially rigid member can be made from metal and/or wood, or other similar materials. The substantially rigid member has edges adapted for interconnection with the substantially rigid member in other moisture resistant members. For example, at least one of the edges comprises a tab and at least one of the edges comprises a groove adapted to receive a tab.

According to another embodiment of the flooring structure, the moisture resistant member has edges adapted for interconnection with other moisture resistant members, the semiconductive member-has edges adapted for interconnection with other semiconductive members, and/or the electrically conductive material extends beyond the edges of the semiconductive member. In some embodiments, conductive adhesive is applied between the electrically conductive material and semiconductive member. For example, the adhesive may comprise conductive epoxy made from carbon loaded epoxy.

There is also provided in accordance with the present invention a process for building an electrostatic discharge floor structure over a base structure, comprising the steps of: laying a moisture resistant material over the base structure, applying a conductive material over at least part of the moisture resistant material, and applying a semiconductive layer over at least part of the conductive material. According to a further aspect of the invention, the process comprises attachment of a resistive member between the conductive material and ground. The resistive member may comprise a variable resistor for providing an adjustable floor structure resistance. There is further provided in accordance with one aspect of the present invention, a process for building an ESD flooring structure, including placement of a substantially rigid material of substantially planar shape between the moisture resistant member and the electrically conductive material. A further aspect of the present invention provides a process for detecting the continuity of certain lead wire connections between the floor and electrical ground, and may also provide a process for the measuring the resistance between a surface of the semiconductive layer and ground, and/or adjusting the resistance to a desired value by adjustment of a variable resistor.

In one aspect of the present invention, a flooring system is provided wherein a floor is comprised of multiple flooring structures, each of which can have a different resistance. In this way, various tasks can be carried out on the same floor, even though the tasks require different resistances to ground; for example, explosive work and semiconductor circuit handling can be performed on different flooring structures of the same floor.

In accordance with yet another aspect of the invention, there is provided a moisture sensor comprising a moisture-variable resistive member, a first conductive member and a second conductive member positioned such that current may flow between the first and second conductive members through the moisture-variable resistive member. According to one aspect of the invention, the moisture-variable resistive member comprises a foam positioned between the first and second conductive members.

BRIEF DESCRIPTION OF THE DRAWINGS

Further features and advantages will become apparent from the following and more particular description of embodiments of the invention, as illustrated in the accompany drawings in which like reference characters refer to the same elements or functions throughout the views, and in which.

DETAILED DESCRIPTION

It is to be understood that while the drawings are intended to illustrate the features of the invention, the drawings are not necessarily drawn to scale.

Figure 1:
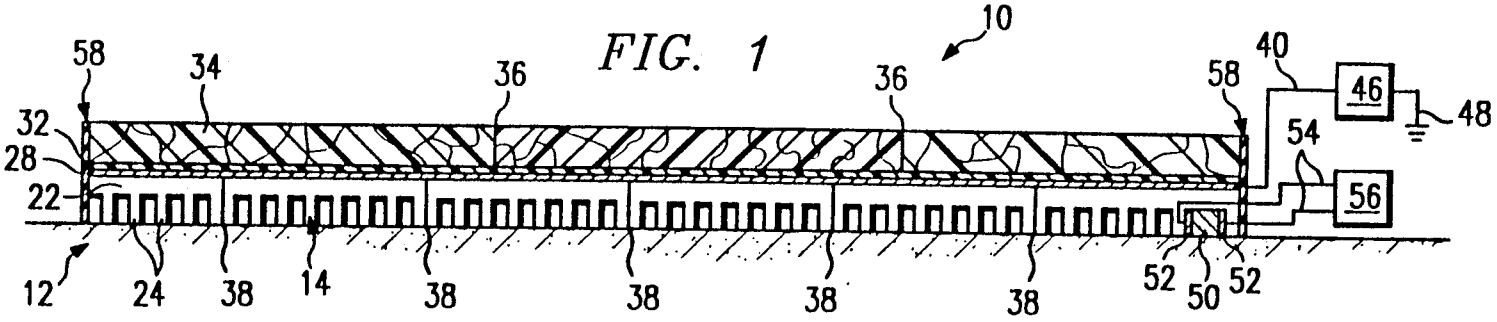
FIG. 1 is a cross sectional view of an embodiment of the flooring structure of the invention.

FIG. 1 illustrates an embodiment of one aspect of the invention which includes different layers of a flooring structure 10 of the present invention, and illustrates connections to electronic-circuitry. For best results, the flooring structure 10 should be placed on top of a flat rigid surface, such as a concrete floor 12. Flooring structure 10 includes a moisture resistant bottom layer 14 of interlocking modular cushion tiles 16. In this embodiment, modular cushion tiles 16 are made by Plastic Safety Systems, Inc., are made of polyvinyl chloride, and come in sizes of 12 inches by 12 inches by ¾ inches high.

Figure 1A:
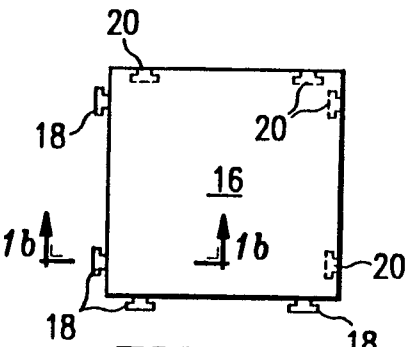
FIG. 1*a* is a top view of one of the bottom layer tiles of an embodiment of the flooring structure.

In the embodiment shown in FIG. 1*a*, two sides of each modular cushion tile 16 have two male T tabs 18, while the other two sides of each modular cushion tile 16 have two female T slots 20. Modular cushion tiles 16 are placed next to each other with the male T tabs 18 of one modular cushion tile 16 locked into the female T slots 20 of an adjacent modular cushion tile. Thus, bottom layer 14 can be made up of any number of interlocking modular cushion tiles 16.

Figure 1B:
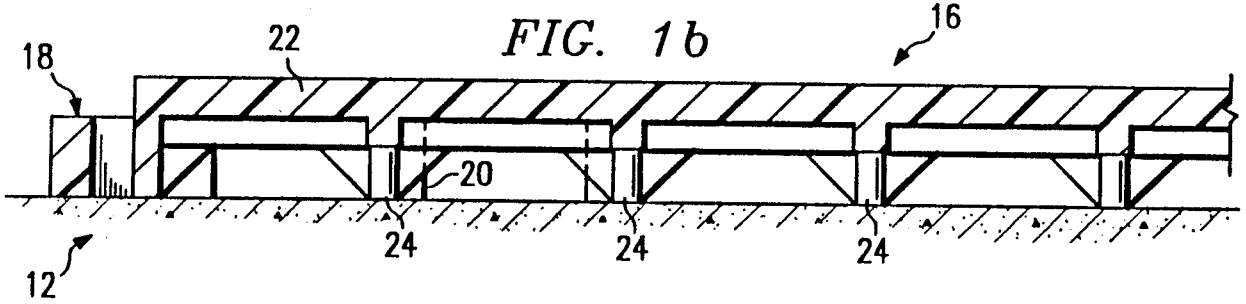
FIG. 1*b* is an enlarged cross-sectional view taken along lines 1*b*—1*b* the bottom layer tile of FIG. 1*a*.

In the embodiment shown in the cross-sectional view in FIG. 1*b*, the modular cushion tiles comprise a planar body 22 supported by support members 24. The spaces between the planar body 22 and the concrete floor 12 created by the spaces between the support members 24, provide space for collecting moisture, thereby preventing moisture from seeping towards the upper layers of flooring structure 10. Modular cushion tiles 16 can have a flat surface on the underside, or alternatively can have small depressions on the underside to improve epoxy bonding as is further discussed below.

An alternative to using modular cushion tiles 16 for the bottom layer 14 is to use pieces of plywood to form planar body 22 placed on top of support members 24 which may be formed of, for example, wood such as two-by-fours or one-by-sixes. Such use of wood for the bottom layer would require an additional layer of moisture resistant material between the base surface and the middle conducting layer to prevent electrical conduction through any collected moisture.

In one aspect of the present invention, strips of conductive tape 28 are placed on top of bottom layer 14 to form a layer of electrically conductive material 28. The arrangement of conductive tape 28 will be described in further detail below. 3M makes conductive tape called Scotch TM brand foil shielding tapes. Scotch TM foil shielding tape Nos. 1245 and 1345 have been found to have the best performance characteristics for the flooring structure 10. Tape No. 1245 is an embossed, dead soft, copper foil tape, with adhesive on the backing. The copper foil tape is conductive through the adhesive. This copper foil tape has the characteristics of static grounding and good solderability. Tape No. 1345 is an embossed, dead soft, tin-alloy coated (on both sides) copper foil tape, with an adhesive on the backing. This tape is also conductive through the adhesive. The characteristics of this tape are static grounding, the greatest solderability, and the greatest corrosion resistance of the Scotch TM brand foil shielding tapes. Conductive tape 28 is affixed to the top of bottom layer 14 by the adhesive backing of the conductive tape. An alternative conductive material to using conductive tape 28 is to use a metal screen or mesh.

In accordance with one embodiment of the invention shown in FIG. 1, a layer of conductive epoxy 32, which acts as an adhesive, is placed on top of conductive tape 28, and may also cover areas of bottom layer 14 not covered with the conductive tape 28. The modular cushion tiles 16 can be designed to have small depressions in their surface so that the conductive epoxy 32 will seep into the exposed depressions not covered by semiconductive tape 28 and create greater bonding between the modular cushion tiles 16 and the conductive epoxy 32. American Halmitins makes a conductive epoxy called Helmicol No. 3022 which is a carbon-loaded epoxy. The resistivity of Helmicol No. 3022 can be changed by changing the concentration of the carbon. For example, a large concentration of carbon in the mix will make the conductive epoxy more conductive.

Figure 2:
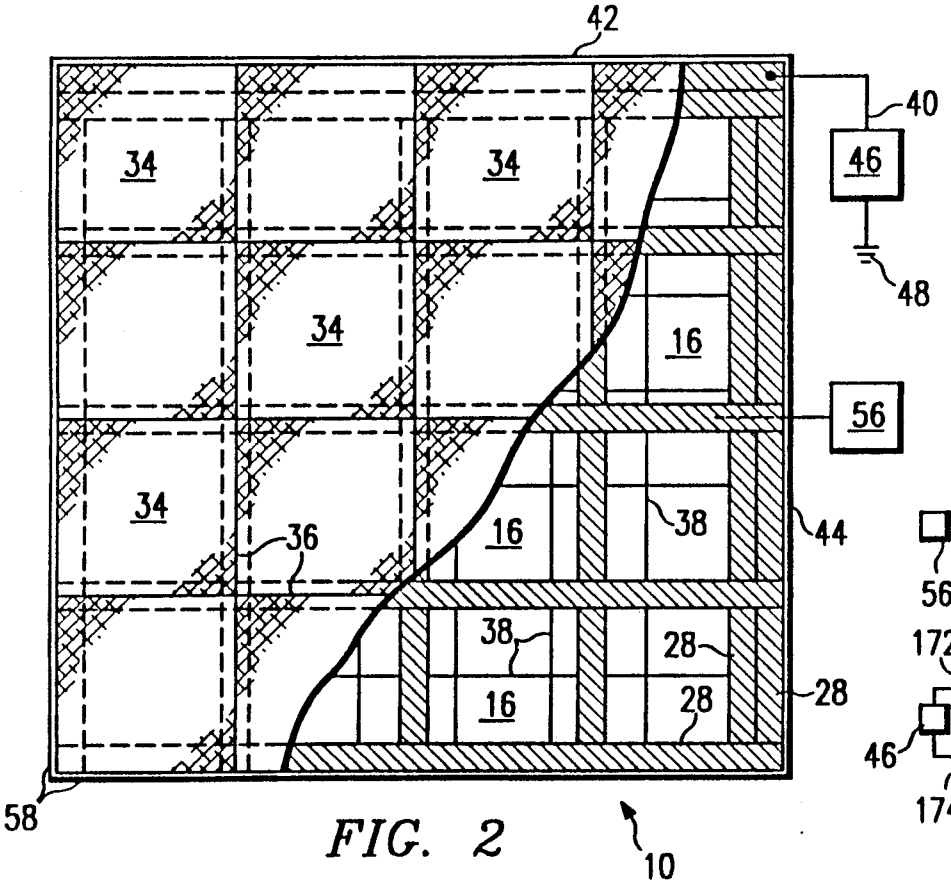
FIG. 2 is a top view of an embodiment of the flooring structure with layers partially broken away.

When using Helmicol No. 3022 as the epoxy, one should wait fifteen minutes before semiconductive tiles 34 are placed on top of the layer of conductive epoxy 32. The fifteen minute wait improves the bonding qualities of conductive epoxy 32. Semiconductive tiles may be made of vinyl impregnated with carbon particles, such as those manufactured by Flexco® company. These semiconductive tiles are available in sizes of one foot by one foot, two feet by two feet, three feet by three feet, or in rolls of much larger sizes. Tiles of three feet by three feet or two feet by two feet have been found to be effective. FIG. 2 illustrates the semiconductive tiles 34 as two feet by two feet in relation to the size of the one foot modular cushion tiles 16. In the embodiments shown in FIGS. 1 and 2, the semiconductive tiles 34 are placed next to each other. The semiconductive tiles 34 are arranged so that the seams 36 of the semiconductive tiles 34 do not overlap the seams 38 of the modular cushion tiles 16 below. This arrangement provides a much stronger flooring structure. The seams 36 of the semiconductive tiles 34 should be sealed to prevent surface moisture from penetrating to the lower tiles (i.e., moisture resulting from mopping the floor).

A typical commercial technique used in some embodiments for sealing semiconductive tiles 34 is to place a vinyl bonding strip in the seams 36 between the semiconductive tiles 34 and to fuse the vinyl bonding strip to the semiconductive tiles 34 by heat application. Bonding strips purchased from Dyess Co., Inc., 3228 Collinsworth, Fort Worth, Tex. 76107, are well suited for use in the present invention.

The strips of conductive tape 28 under the semiconductive tiles 34 and the layer of conductive epoxy 32 can be arranged in a lattice arrangement (FIG. 2) and in one embodiment, the lattice arrangement of the conductive tape 28 and the positioning of the semiconductive tiles 34 should be such that the conductive tape 28 overlaps the perimeter 36 of each semiconductive tile 34 on the underside of the semiconductive tiles 34 (FIG. 2), and the conductive tape 28 should be wide enough so that a strip of conductive tape will overlap one side of the perimeter of a semiconductive tile 34 and overlap the side on the perimeter of an adjacent semiconductive tile.

The Scotch TM brand foil shielding tapes come in widths of two inches, inches, six inches, and thirty-six inches. The two inch foil shielding tape provides sufficient overlap of adjacent semiconductor tiles 34. As is shown in the embodiment of FIG. 2, when the conductive tape 28 is placed in this arrangement, it forms a lattice of conductive tape. As is also shown in FIG. 2, the seams 36 of the semiconductive tiles 34 are positioned along the center of each strip of conductive tape 28. Conductive tape 28 is also placed around the perimeter of the flooring structure 10 on top of bottom layer 14. A ground wire 40 is attached, for example by soldering, to the conductive tape 28 at one of the corners of the flooring structure 10 (FIG. 2). The two sides 42 and 44 of flooring structure 10 which meet at the point where ground wire 40 is attached have twice the width of conductive tape as compared to the rest of the conductive tape lattice. The greater width of conductive tape provides better conductivity to the ground wire 40.

Ground wire 40 leads to a variable resistance circuit 46 (described below) and then to electrical ground 48. The best grounding is achieved by attaching the ground wire 40 to the green wire ground of a main fuse box.

Figure 3:
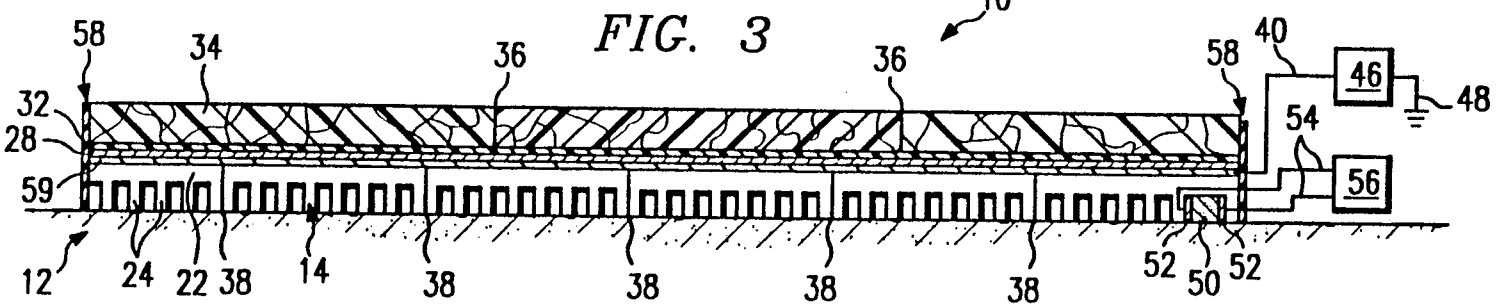
FIG. 3 is a cross-sectional view of an embodiment of the flooring structure of the invention.

According to an alternative aspect of the invention, a moisture detector is provided to detect the presence of moisture. The moisture detector can be used to detect moisture underneath a bottom layer 14 of the flooring structure 10, but can also be used in other applications. In one application, the moisture detector is constructed from a moisture-variable resistive member 50 and two conductive members, such as two pieces of conductive tape 52 (as seen in FIG. 3).which are positioned on either side of the moisture-variable resistive member 50. The moisture-variable resistive member 50 has resistivity that changes (i.e., decreases) in the presence of moisture.

An example of a moisture-variable resistive member 50 as shown in FIG. 3 is conductive foam material 50, which becomes more conductive as it absorbs moisture. In this embodiment, conductive foam material 50 is placed under the planar body 22 of modular cushion tiles 16 in the space between support members 24. 3M manufactures a conductive foam material in a dense version and a less dense version. The dense conductive foam material is more moisture absorbent than the less dense version. In the embodiment shown in FIG. 3, conductive tape 52 is attached to the top and bottom of the conductive foam material 50, and wires 54 are attached, for example by soldering to the conductive tape 52. Alternatively, the conductive tape 52 can be placed on the sides of the conductive foam material 50. The wires 54 lead to a moisture detector circuit 56 (an embodiment of which is described below).

In accordance with another embodiment of the invention, a molding strip 58 is affixed around the periphery of flooring structure 10 (FIGS. 2 and 3). Molding strip 58 should be comprised of insulator-type materials, and should be moisture resistant. Rubber or polyvinyl chloride are good materials for molding strip 58, as is Dow Corning's 100% silicone rubber (clear). In this embodiment, the combination of bottom layer 14, which is an insulator and which is moisture resistant, and molding strip 58, which is also a moisture resistant insulator, insures that flooring structure 10 is water resistant and insulated around the periphery-and the bottom from objects that might interfere with its electrostatic discharge properties.

The resulting flooring structure 10 is strong, resilient, durable, and moisture resistant. Flooring structure 10 can withstand a force of at least 500 pounds per square inch. Thus, flooring structure 10 is unaffected by most heavy machinery and equipment.

Figure 11:
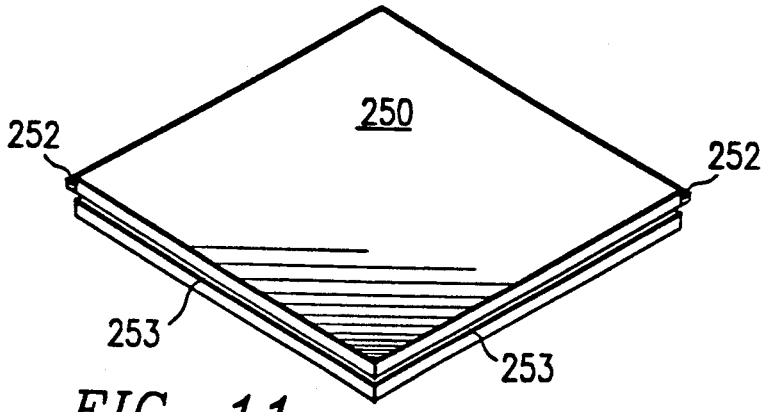
FIG. 11 is a perspective view of an embodiment of the invention which comprises tongue-in-groove members for attaching tiles of a flooring structure to make a flooring system.
Figure 12:
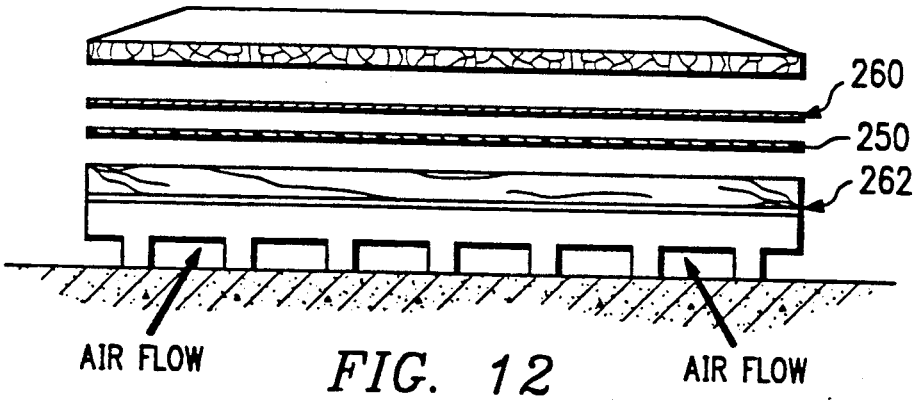
FIG. 12 is a cross-sectional view of an embodiment of the invention which comprises a layer of substantially rigid material positioned between the moisture resistant material and the electrically conductive material.

The embodiment shown in FIG. 3 provides an even stronger floor structure because of the inclusion of a substantially rigid material 59, such as a 3/16 inch thick metal plate, with an area equal to the area of bottom layer 14. The plate 59 can be placed on top of bottom layer 14 before the conductive tape 28, conductive epoxy 32 and semiconductive tiles 34 are added. The addition of metal plate 59 increases the strength of flooring structure 10 so that it can withstand even greater forces. Alternatively, plywood (for example, ½" or ¾") may be used in place of metal plate 59, or some other substantially rigid material may also be used. In an embodiment as shown in FIG. 11, the plywood 250, which is the substantially rigid material 59, has tabs 252 and slots 253 for interconnecting adjacent pieces. As shown in FIG. 12, the substantially rigid material 250 is placed between electrically conductive material 260 (FIG. 12) and moisture resistant material 262. The substantially rigid material 250 does not have to be the same dimensions as the tiles, but it may be.

Flooring structure 10 contains electrical properties such that electrostatic charges are dissipated at a desired rate. With the ESD flooring structure of the present invention, electrostatic charges formed, for example by the movement of people or equipment, do not accumulate, but are instead dissipated into the semiconductive tiles 34 (see FIG. 1). Then, the charges pass from the semiconductive tiles into the more conductive underlying layers which may contain both conductive epoxy layer 32 and conductive tape 28. Finally, the charges are dissipated through ground wire 40 attached to conductive tape 28 and on through the variable resistor 46 located in the control box to the electrical ground 48.

Figure 4:
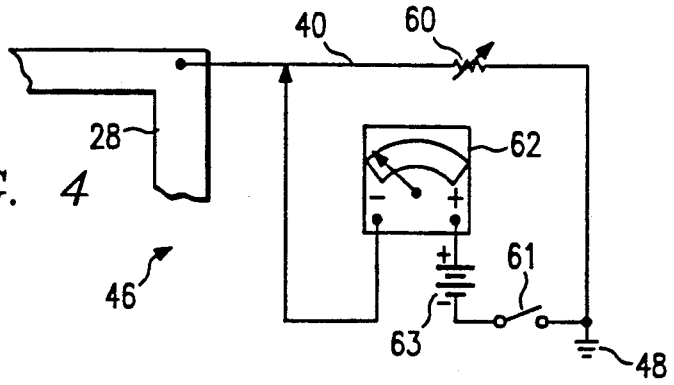
FIG. 4 illustrates an embodiment of electronic circuitry for monitoring and adjusting the resistance of the flooring structure.

The dissipation rate of the charges depends on the resistance of the materials used to make flooring structure 10. A higher resistance slows the dissipation rate and minimizes static discharge, while a lower resistance increases the dissipation rate. A problem is that the resistance of the materials (the semiconductive tiles 34, the conductive epoxy layers 32, and the conductive tape 28) tends to change because the resistance is affected by such factors as temperature, humidity and aging. Referring now to the embodiment shown in FIG. 4, this problem is solved by the insertion of a variable resistance 60 between the ground wire 40 (which is coupled to the conductive tape 28) and ground 48. Examples of variable resistors suitable for variable resistance 60 include: a decade box, a wirewound rheostat, or a potentiometer. In order to monitor the resistance of the flooring structure, a resistance monitor can be connected across variable resistance 60.

In some embodiments, an ohmmeter 62 may be connected across variable resistance 60 to determine its resistance value. A battery 63 having sufficient voltage which is in series with ohmmeter 62 powers the ohmmeter. A switch 61 is used to activate ohmmeter 62. The circuit containing variable resistance 60 and ohmmeter 62 is designated as 46 in FIG. 1. Thus, whenever the resistance of the flooring structure 10 varies from the desired value, the variable resistance 60 can be adjusted accordingly. Increasing the resistance of variable resistor 60 decreases the dissipation rate, while decreasing the resistance of variable resistor 60 increases the dissipation rate.

As discussed above, bottom layer 14 comprises a planar body 22 which-is raised above the concrete floor 12 by support members 24 so as to prevent any moisture from seeping into the upper layers. Therefore, flooring structure 10 works well even in the presence of moisture. However, such moisture might eventually pose problems to flooring structure 10 if there-are significant amounts of this moisture and the moisture is present for long periods of time. Furthermore, the very presence of moisture should be investigated. Therefore, one aspect of this invention includes a moisture detector 56 which detects the presence of moisture.

In one embodiment of the moisture detector invention as used in combination with the ESD flooring structure as illustrated in FIG. 1, conductive foam material 50 is placed under planar body 22 of bottom layer 14. Conductive foam material 50 can be placed in as many areas under bottom layer 14 as desired to detect moisture in remote areas under flooring structure 10. However, since the surface 12 upon which flooring structure 10 is placed is usually flat, the moisture on the surface 12 will usually uniformly spread throughout the surface so that a minimum amount of conductive foam material 50 need be placed under bottom layer 14 to detect moisture.

Figure 5:
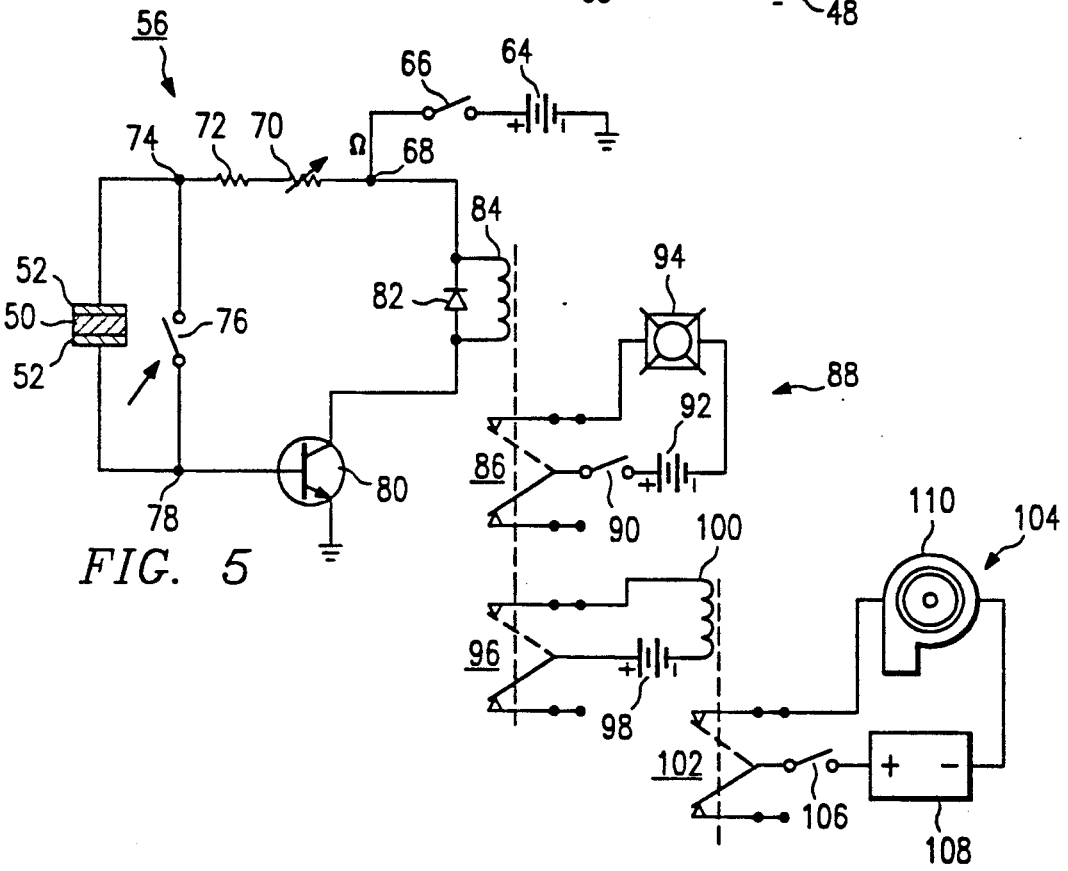
FIG. 5 illustrates an embodiment of electronic circuitry for detecting moisture and for drying moisture.

One embodiment of the moisture detector as shown in FIG. 5 comprises a moisture detector circuit 56 having a 9-volt battery 64 which has a first terminal connected to ground and a second terminal connected to a switch 66. Switch 66 is connected in series between battery 64 and node 68. A variable resistance 70 and a resistor 72 are connected in series between node 68 and a node 74. A switch 76 is connected between node 74 and a node 78. Node 78 is connected to the base terminal of a transistor 80. The emitter of transistor 80 is connected to ground and the collector is connected to the anode of a diode 82. Alternatively, the emitter of transistor 80 can be coupled directly to the first terminal of battery 64. The cathode of diode 82 is connected to node 68. A relay 84 is connected in parallel with diode 82. Relay 84 serves to activate a pole switch 86 to close a contact and complete an alarm circuit.

One embodiment of an alarm circuit 88 shown in FIG. 5 comprises a switch 90 in series with a battery 92 and a light or sound alarm 94. Relay 84 also serves to activate a pole switch 96 to close a contact and complete a circuit of a 9-volt or 12-volt battery 98 in series with a relay 100. Relay 100 serves to activate a pole switch 102 to close a contact and complete a blower circuit 104. Blower circuit 104 comprises a switch 106 connected in series with a 115-volt AC power source or a 24-volt DC power source 108 and a centrifugal blower 110.

The embodiment of the moisture detector circuit 56 shown in FIG. 5 works as follows. Switch 66 is normally closed while switch 76 is normally open. Switch 66 serves to disconnect the 9-volt battery 64 from the rest of the circuit. Switch 76 is used when setting the sensitivity of the moisture detector circuit 56. When there is no moisture in the conductive foam material 50, the conductive foam material 50 has a very high resistance. If conductive foam material 50 has a very high resistance (i.e., is dry) and if switch 76 is open, then the base-emitter voltage will be too low to turn on transistor 80. If there is no moisture and switch 76 is closed, transistor 80 might or might not be turned on, depending on the values of resistor 72 and variable resistance 70. Resistor 72 is a set resistance of 5000 ohms. Variable resistance 70 can be adjusted, thus changing the base-emitter voltage of transistor 80, so that transistor 80 is turned on. Once this adjustment is made switch 76 is opened. Thus, if conductive foam material 50 becomes more conductive because of the presence of moisture, and has a very low resistance, then transistor 80 will be turned on. Since conductive foam material 50 becomes more conductive and less resistive as it absorbs moisture, if only small amounts of moisture are present, conductive foam material 50 might still have a high resistance value. Therefore, variable resistance 70 can be adjusted so that the base-emitter voltage of transistor 80 is large enough to turn on transistor 80 even if a high resistance from conductive foam material 50 is added in series with resistor 72 and variable resistance 70. Variable resistance 70 can also be adjusted so that if small amounts of moisture are present and conductive foam material 50 has a high resistance, then the resistance of conductive foam material 50, resistor 72 and variable resistance 70 is too high resulting in the base-emitter voltage being too low to turn on transistor 80. In the latter situation, variable resistance 70 should be adjusted so that-although transistor 80 does not turn on at low levels of moisture, if higher levels of moisture are present making conductive foam material 50 less resistive, the base-emitter voltage is large enough to turn on transistor 80.

When transistor 80 is on, current flows through relay 84 causing pole switch 86 to move in a closed position. Whenever pole switch 86 is opened and closed, a high-voltage spike is generated; diode 82 acts to short circuit this spike. Since switch 90 is normally closed, the closing of pole switch 86 creates a complete circuit for alarm circuit 88. Battery 92, which is then in series with alarm 94, sets off alarm 94 indicating the presence of moisture has been detected. Switch 90 can be opened to shut off alarm 94.

When current flows through relay 84, pole switch 96 also moves in a closed position creating a complete circuit for battery 98 in series with relay 100. Current then flows through relay 100 which causes pole switch 102 to move in a closed position creating a complete circuit for blower circuit 104. The power source 108 then activates centrifugal blower 110.

Multiple blower circuits designed exactly like blower circuit 104 can be tied into relay 100. Switch 106 of blower circuit 104 is normally closed but can be opened to shut off centrifugal blower 110. Since alarm circuit 88 and blower circuit 104 are separate circuits, either circuit can be active, or can be shut off by its switch without affecting the other circuit.

Figure 6:
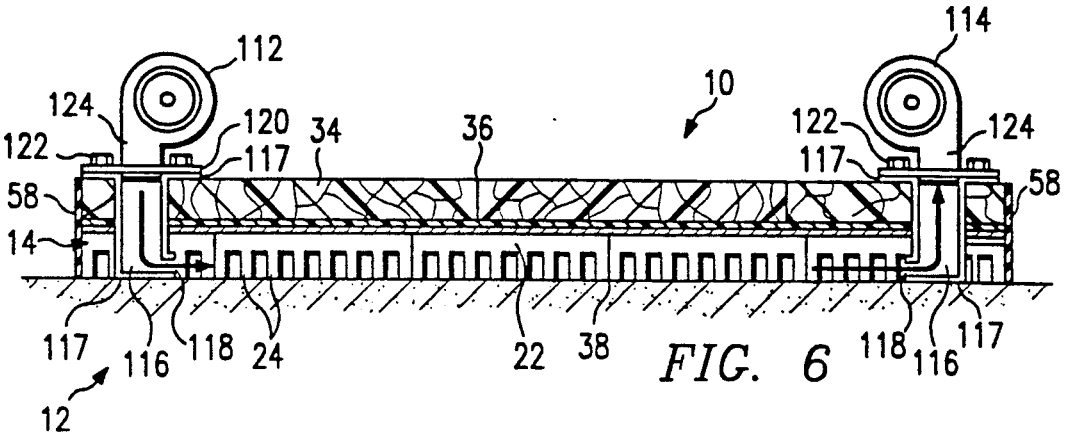
FIG. 6 is a cross-sectional view of an embodiment of the flooring structure with means for drying moisture installed in the flooring structure.
Figure 7:
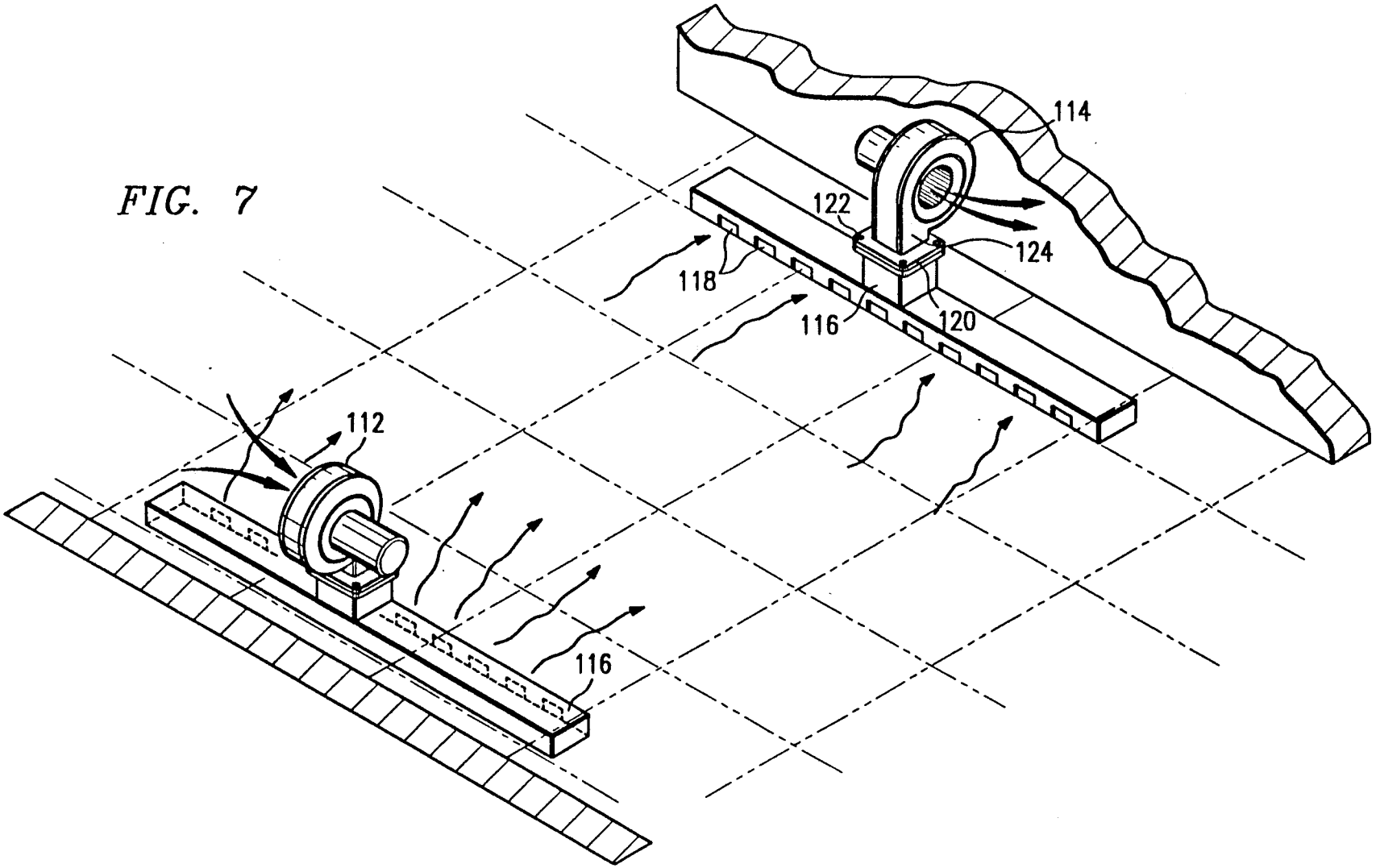
FIG. 7 is a perspective view from the top of an embodiment of the flooring structure illustrating means for drying moisture installed in the flooring structure.

Centrifugal blowers 110 are activated as described above when moisture is present, and are used to dry moisture under planar body 22 of bottom layer 14. The embodiments shown in FIGS. 6 and 7 illustrate how centrifugal blowers 110 are installed in flooring structure 10. Ideally, two blowers 112 and 114 should be installed on opposite ends of flooring structure 10. Centrifugal blowers 112 and 114 should be installed about 6 inches inward from their respective ends of flooring structure 10. A 1.5 inch by 6 foot opening is cut from the top to the bottom of flooring structure 10 at each end of flooring structure 10 where the centrifugal blowers 112 and 114 will be installed. Duct work 116 with vent openings 118 is placed into each opening cut into the flooring structure 10. Duct work 116 should be comprised of, or at least be covered with a layer of, insulating material 117 to prevent the duct work 116 from interfering with the electrostatic discharge properties of flooring structure 10. The layer of insulating material in this embodiment may be a rubber molding strip or a silicone rubber general purpose sealant made by Dow Corning. Material having a very high resistance values (such as 500 gigaohms) will serve as acceptable insulating material.

When the duct work 116 is installed, vent openings 118 are under planar body 22 of bottom layer 14, and these openings face towards the middle of flooring structure 10. An outlet-flange 120 attaches to duct work 116 and lies flat on top of semiconductive tile surface 34. The outlet flange 120 is bolted into flooring structure 10 through holes 122 in the outlet flange. When duct work 116 and outlet flanges 120 are installed, the centrifugal blowers 112 and 114 can be installed. Suitable centrifugal blowers are manufactured by Rotron. In some embodiments, the blowers have an output horsepower rating of $\frac{1}{3}$ HP and operate off of 120 VAC at 500 watts. Each centrifugal blower 112 and 114 has a centrifugal blower outlet 124. This centrifugal blower outlet is inserted into outlet flange 120. Centrifugal blowers 112 and 114 are installed into their respective flanges in this manner.

In one embodiment, the centrifugal blowers 112 and 114 are designed with both blower rotations in one direction so that air comes in from the sides of the centrifugal blower and is blown out of the centrifugal blower outlets. However, centrifugal blowers 112 and 114 should have opposite blower rotations for best results. If the centrifugal blowers rotate in opposite directions as illustrated in FIGS. 6 and 7, centrifugal blower 112 blows air out of its centrifugal blower outlet into duct work 116, and the air is blown out of the vent openings 118 under planar body 22 towards the middle of flooring structure 10. The rotation of centrifugal blower 114 is in the opposite direction and sucks the air flow from centrifugal blower 112 through its vent openings 118 into its outlet flange 120 where finally the air is blown out of the sides of centrifugal blower 114.

Figure 8:
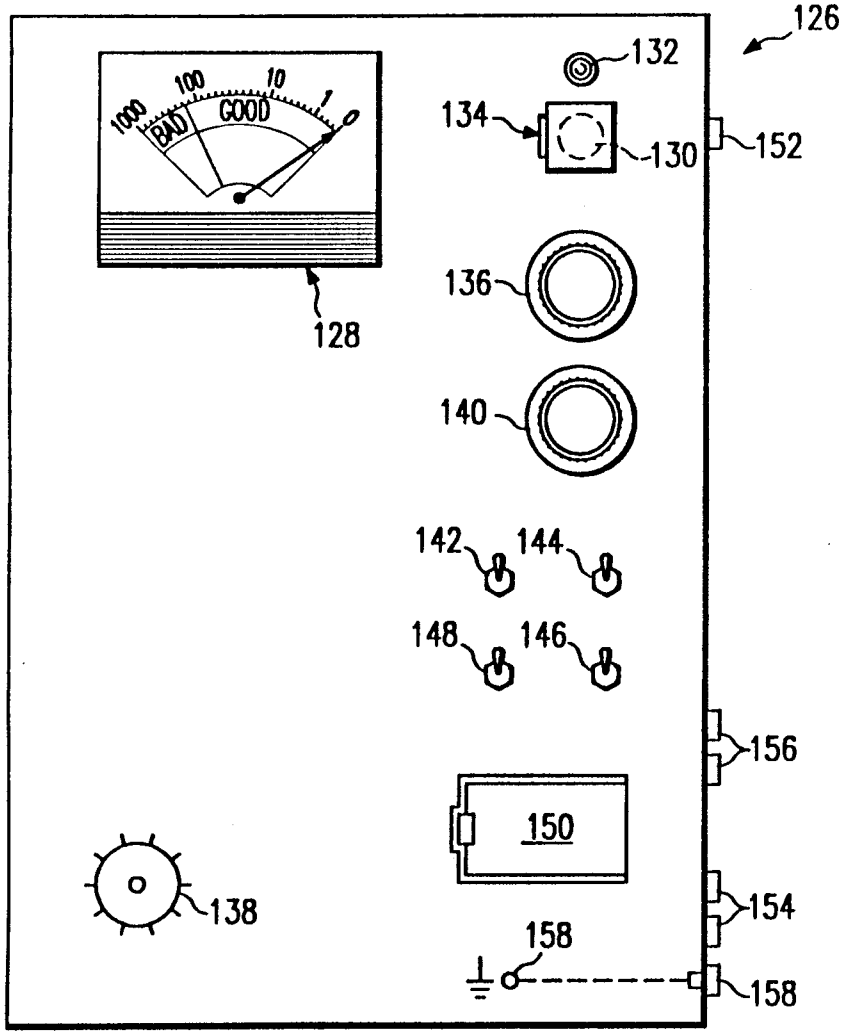
FIG. 8 illustrates the face of an electronic control box which consolidates the electronic circuitry illustrated in FIGS. 4–5.

In a further aspect of the present invention, variable resistance circuit 46 and moisture detector circuit 56 can be consolidated into an electronic control box 126. FIG. 8 illustrates the face of electronic control 126. Electronic control box 126 includes an ohmmeter 128 which is powered by battery 130 when push button switch 132 is on. Clearly, ohmmeter 128 performs the same function as ohmmeter 62 in FIG. 4, but is hooked up differently to its battery supply. The electronic control box 126 has an access door 134 to access battery 130. Knob 136 is used to adjust the variable resistance 60 in variable resistance circuit 46 (see FIG. 4). The electronic control box 126 has an alarm 138 which is the moisture detector circuit 56 alarm. Knob 140 is used to adjust the variable resistance 70 in moisture detector circuit 56 (see FIG. 5). Electronic control box 126 has four on/off switches 142, 144, 146, and 148. On/off switch 142 is used to activate battery 64 just as switch 66 does in moisture detector circuit 56 (FIG. 5). On/off switch 144 is used to couple the transistor to the variable resistance just as switch 76 does in the moisture detector circuit 56. On/off switch 146 is used to activate the battery 92 just as switch 90 does in the alarm circuit 88, and switch 148 is used to activate battery 108 just as switch 106 does in the blower circuit 104. The electronic control box 126 also has an access door 150 which accesses batteries 64 and 92, and battery 98 can also be accessed. Electronic control box 126 also has several plug-in or screw terminals.

The lead wire from the flooring structure, shown as ground wire 40 in FIG. 1, is plugged into or screwed to terminal 152. It is important for a proper understanding of one aspect of the invention that the lead wire may extend over a considerable distance, and may therefore be subject to breakage or other discontinuity. One aspect of the present invention, as explained below, is to check for the continuity of this lead wire from the flooring structure to the control box 126. The two leads from centrifugal blower 110 are plugged into or screwed to terminals 154. The two wires 54 attached to the conductive tape on conductive foam material 50 are plugged into or screwed to terminals 156. Ground 48, which is preferably coupled to a green wire ground as explained above, is connected to electronic control box 126 through plug-in or screw terminals 158.

Figure 9:
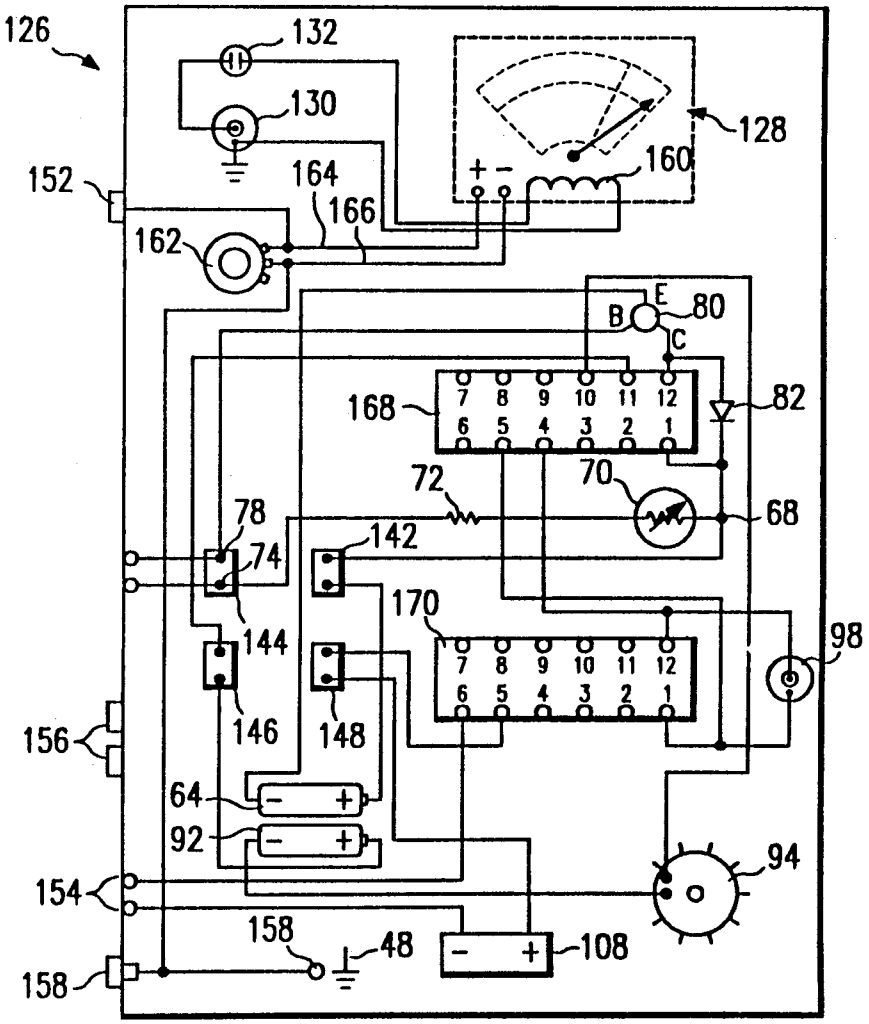
FIG. 9 is a wiring diagram of the internal circuitry of the control box in FIG. 8.

FIG. 9 is a wiring diagram of the internal circuitry of an embodiment of electronic control box 126. When push button switch 132 is on, this completes a circuit with battery 130 in series with a coil 160 which is part of ohmmeter 128. When battery 130 is in series with solenoid 160, this energizes coil 160 so that ohmmeter 128 is ready to make a resistance reading. The variable resistance 60 for variable resistance circuit 46 is illustrated in FIG. 9 as a potentiometer-162. Potentiometer 162 is connected in series with terminal 152, to which ground wire 40 is connected, and ground 48. Ohmmeter 128 is connected in parallel with potentiometer 162, by wires 164 and 166.

Not only does ohmmeter 128 provide a measurement of the resistance value of potentiometer 162, but the ohmmeter 128 can also indicate that the flooring structure 10 is properly grounded in the following way: after the flooring structure is properly set to the desired resistance value (as will be explained below), a series of ohmmeter readings are taken over time. It will be appreciated that if the flooring structure 10 is grounded only through the variable resistance/potentiometer 162, then ohmmeter 128 will only measure the resistance of potentiometer 162. However, if the floor 10 is ever grounded through some other, additional contact to ground, ohmmeter 128 will be measuring the resistance of the potentiometer 162 coupled in parallel with the newly grounded floor 10. So long as the battery supply 130 for ohmmeter 128 is sufficiently large to push current through the newly grounded floor 10, the reading on ohmmeter 128 should be changed from its reading prior to the secondary grounding of the floor 10 (i.e., a grounding through a path other than the potentiometer). Any such change in the ohmmeter reading provides an indication that the floor is improperly grounded, and corrective measures to restore the proper grounding of the floor can then be taken.

The rest of the wiring diagram of FIG. 9 illustrates the circuitry of the moisture detector circuit 56 which includes alarm circuit 88 and blower circuit 104. The wiring diagram illustrates two relays 168 and 170. Relays 168 and 170 are numbered with twelve solder terminals. Battery 64 of the moisture detector circuit in FIG. 5 has one terminal connected to ground and the other terminal connected to switch 66. In an alternative embodiment shown in FIG. 9, battery 64 is connected between switch 142 and transistor 80. Switch 142 is connected in series between battery 64 and node 68. Variable resistance 70 and resistor 72 are connected in series between node 68 and a node 74. A switch 144 is connected between node 74 and a node 78. Node 78 is connected to the base terminal of transistor 80. The emitter of transistor 80 is connected to ground, as shown in FIG. 5, or alternatively as in FIG. 9, the emitter is connected to battery 64. The collector is connected to the anode of diode 82 and connected to terminal No. 12 of relay 168. The cathode of diode 82 is connected to terminal No. 1 of relay 168. Terminal No. 11 of relay 168 is connected to one terminal of switch 146. The other terminal of switch 146 is connected to the positive terminal of battery 92 of alarm circuit 88. The negative terminal of battery 92 is connected to one terminal of alarm 94. The other terminal of alarm 94 is connected to relay 168 at terminal No. 10. Terminal No. 4 of relay 168 is connected to terminal No. 12 of relay 170. Terminal No. 5 of relay 168 is connected to terminal No. 1 of relay 170. Battery 98, which energizes relay 170, has its positive terminal connected to terminal No. 12 of relay 176 And its negative terminal connected to terminal No. 1. Terminal No. 5 of relay 170 is connected to one terminal of switch 148. The other terminal of switch 148 is connected to the positive terminal of power source 108. The negative terminal of power source 108 leads to one of the terminals 154 for centrifugal blower 110. The other terminal 154 is connected to terminal No. 6 of relay 170.

Figure 10:
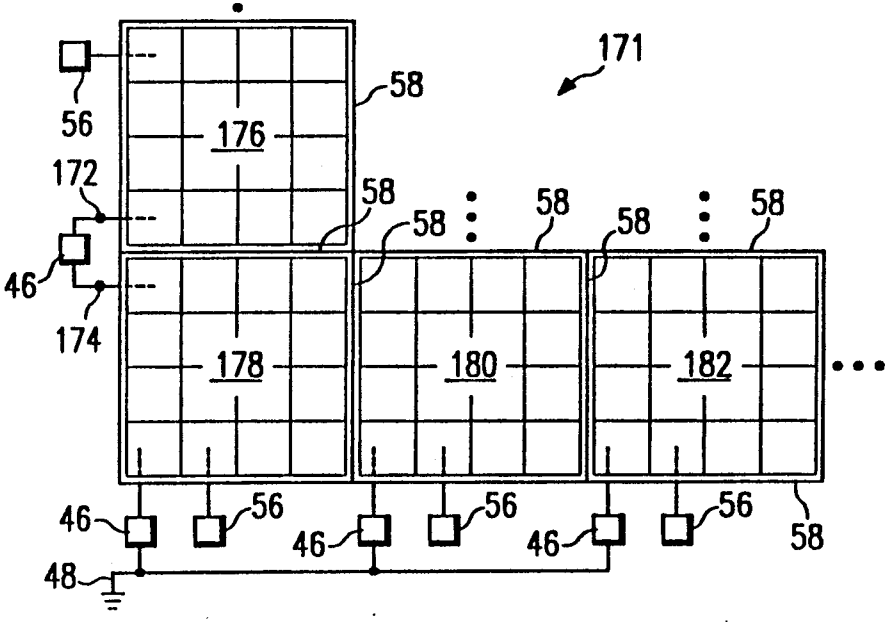
FIG. 10 is a top view of a flooring system containing multiple flooring structures.

FIG. 10 illustrates a flooring system 171 containing multiple flooring structures 176, 178, 180, and 182 which have the same structure as flooring structure 10. Each flooring structure 176, 178, 180 and 182 has a moisture detector circuit 56. Flooring structures 180 and 182 each have a variable resistance circuit 46 which is tied to a common ground 48. Since flooring structures 180 and 182 are insulated from each other, their variable resistances can be adjusted independently from the other flooring structure. As many flooring structures 10 as desired with their variable resistance circuits 46 connected to a common ground can be placed side-by-side.

Flooring structures 10 of flooring system 171 can be connected in series by connecting a variable resistance circuit 46 between flooring structures. Flooring structures 176 and 178 are connected in series by connecting a variable resistance circuit 46 between these flooring structures at points 172 and 174. Of course, the variable resistance circuit 46 connected in series between flooring structures 176, 178 is not grounded itself. The flooring structure 10 at the end of the multiple flooring structures connected in series is connected to ground 48 through a variable resistance circuit 46. As shown in FIG. 10, flooring structure 178 is connected to ground 48 through variable resistance circuit 46. When the flooring structures 10 are connected in series, each flooring structure 10 has its resistance increased by the total resistance of the flooring structures and the variable resistances 60 between it and ground. In FIG. 10, the resistance of flooring structure 176 is increased by the variable resistance 60 in variable resistance circuit 46 connected at points 172 and 174, the resistance of flooring structure 178, and the variable resistance 60 of the variable resistance circuit 46 connected to ground 48.

Flooring system 171 has several benefits. Each flooring structure 10 of flooring system 171 can be set to have a different resistance value. This is beneficial in a facility involving several different operations. For example, persons in one part of a room might be working on explosives, while in the other part of the room persons might be working on an electronic circuit board. The flooring structure 10 which is in the part of the room where the explosives are being worked on should have a lower resistance to quickly dissipate electrostatic charges. The flooring structure at the part of the room where the circuit board is being worked on should be adjusted to have a higher resistance to more slowly dissipate electrostatic charges.

Figure 13:
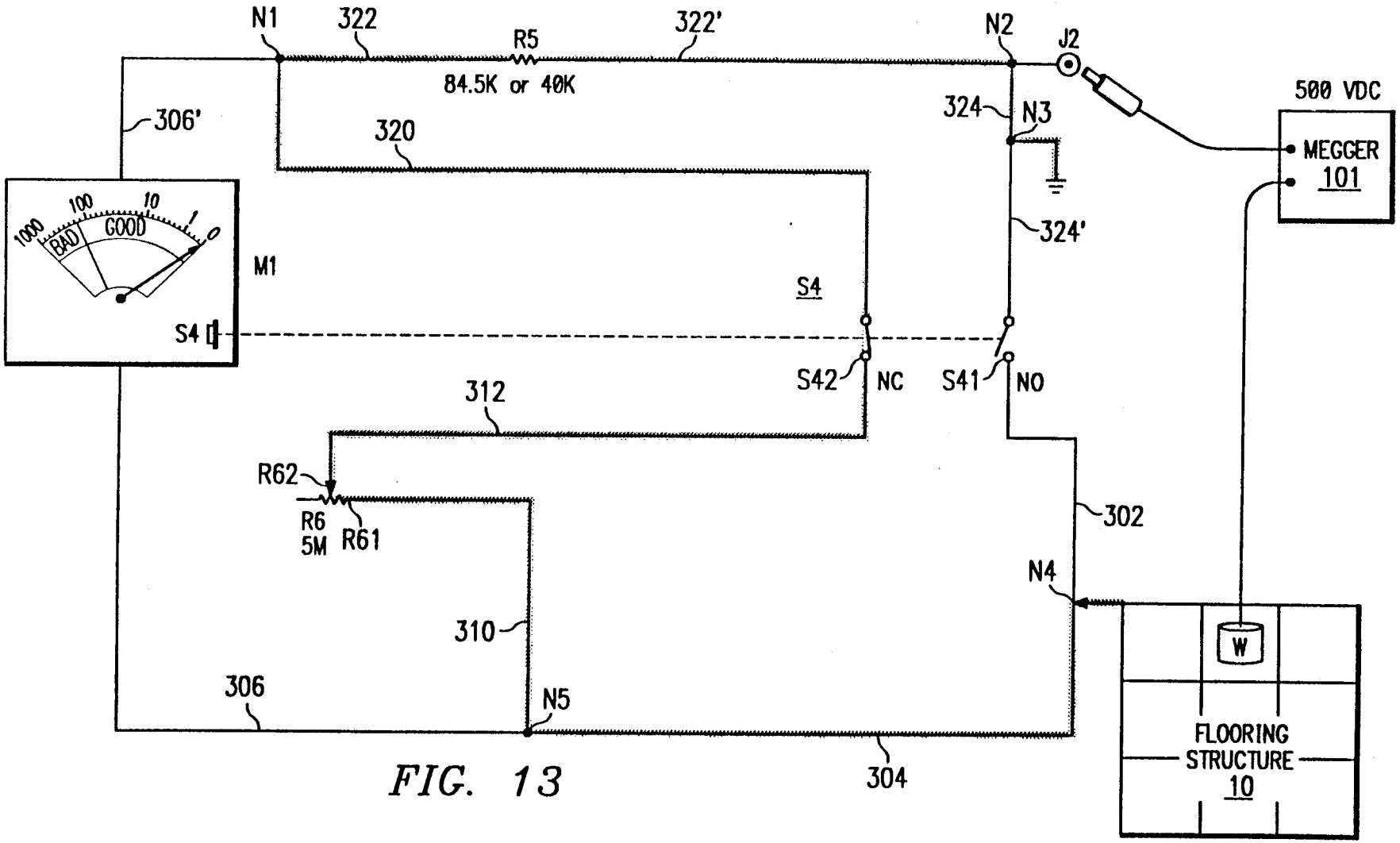
FIG. 13 is a schematic of an embodiment of the invention using various current paths for discharge, floor performance monitoring, and testing having various states.
Figure 14:
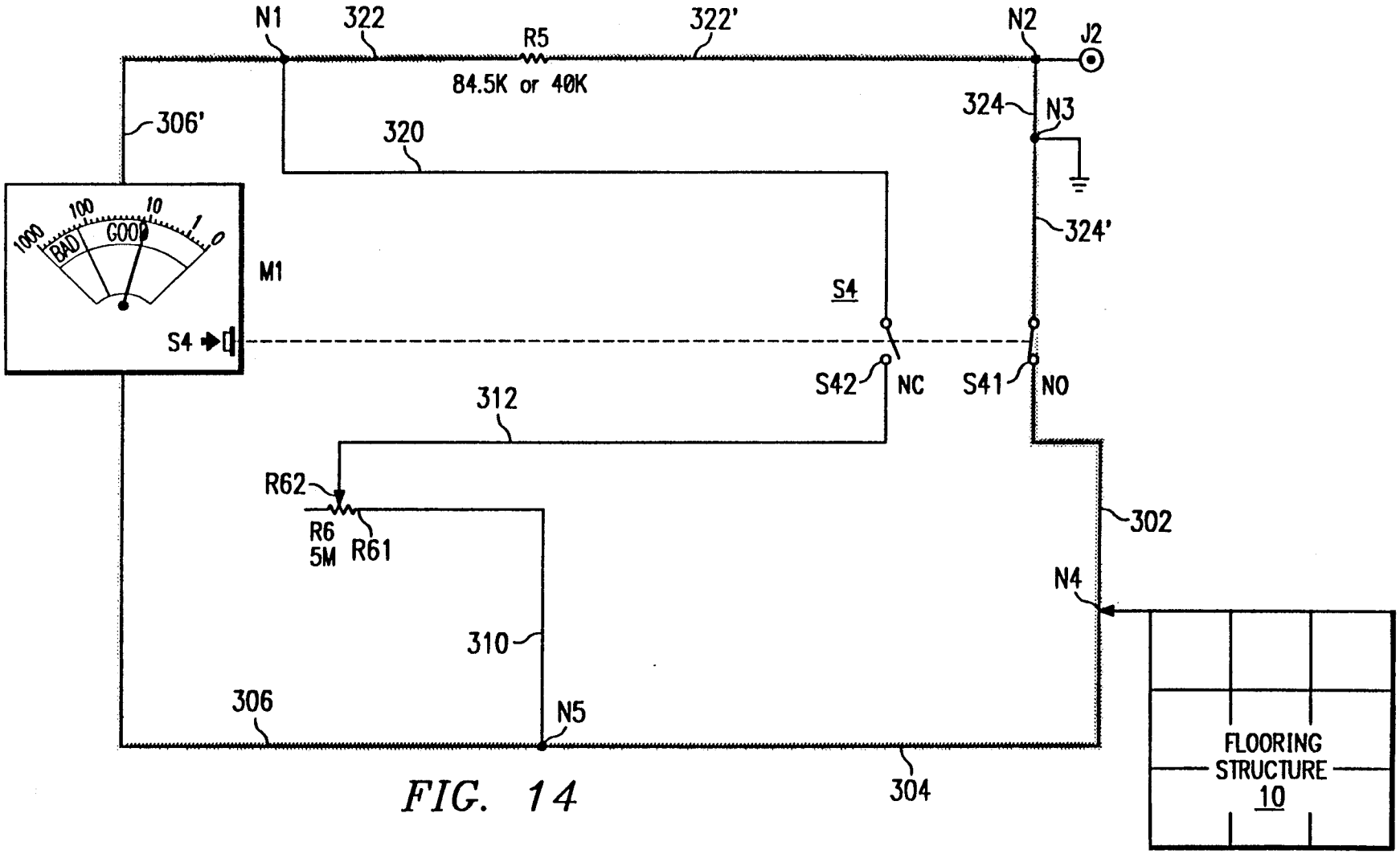
FIG. 14 is a schematic of an embodiment in an alternate state.

Referring now to FIGS. 13–14, an alternative embodiment of the ground continuity checker aspect of the present invention is shown, which is used to perform various testing procedures as explained below. In this embodiment, as seen in FIG. 13 which depicts the normal current discharge path, flooring structure 10 is connected at node N4 to current paths 302 and 304. Current path 302 is connected to normally-open switch S41 which is itself grounded by path 324'. Current path 304 is the lead wire which connects the flooring structure 10 to node N5, which in turn is connected to current paths 306 and 310. Current path 310 is connected to variable resistor R6 at terminal R61. Terminal R62 of variable resistor R6 is connected to current path 312 which is connected to normally-closed switch S42. Current path 320 connects normally-closed switch S42 to node N1. Current path 306 is connected to a negative terminal of resistance monitor M1, and monitor M1 is connected to node N1 by path 306'. Monitor M1 is not activated in the embodiment shown in FIG. 13. Node N1 is ultimately coupled to ground by path 322, which represents the lead wire between node N1 and ground.

In normal operation, switches S41 and S42 are in the position shown in FIG. 13, wherein switch S42 is closed to form a primary current path from the flooring structure through paths 304 and 310, variable resistor R6, path 312, closed switch S42, current path 320, current path 322, resistor R5, current path 322' and current path 324 which is grounded at node N3, preferably to the green wire ground of a standard electrical panel. Node N3 is also connected to switch S41 by current path 324'. In this way, switch S41 forms a secondary current path between ground and the flooring structure.

In order to set the flooring structure 10 to the proper resistance value using the embodiment shown in FIG. 13, an external monitor 101 capable of measuring large resistance values, such as a BM10 battery MEGGER tester, is coupled between the floor structure 10 and the circuit of FIG. 13. In particular, jack J2, which is coupled to node N2, is coupled to one lead of the external MEGGER 101; and a five pound weight W resting on top of the floor 10 is coupled to the other lead from MEGGER 101. The proper resistance for the flooring structure is obtained by adjusting variable resistance R6 to the desired value.

In such an embodiment, a MEGGER BM10 of 500 volts DC applies a bias of 500 volts between a weight W placed on the flooring structure 10 and ground. The MEGGER BM10 is attached to the weight W and to node N2 through test jack J2. Node N2 has a ground potential due to current path 324 to grounded node N3. An ohmmeter display in MEGGER BM10 shows the resistance between the floor weight W and ground, which comprises the sum of resistors R5 and R6 and the resistance of the flooring structure itself. R5 is in the circuit as a safety resistor in case variable resistor R6 has a value of zero, so that there will always be some resistance between flooring structure 10 and ground. The desired resistance for the overall flooring structure resistance may be monitored in the ohmmeter display of MEGGER BM10 as variable resistor R6 is changed.

Because current paths 322' and 304 are the first and second lead wires, respectively, connecting the control box to electrical ground and the flooring structure, these lead wires may extend over a significant distance. It is therefore an important aspect of the present invention to be able to test the continuity of the current paths 322' and 304. (For purposes of the present description, paths 322, 322' and 324 can be considered to comprise the lead wire between node N1 and ground, or path 322' can be the lead wire by itself.) Referring now to FIG. 14, the continuity of current paths 322, 322', 324, and 304 are tested. As shown in FIG. 14, the position of switches S41 and S42 have been changed, breaking the electrical connection at switch S42 and creating an electrical connection at switch S41. The changes in switches S41 and S42 are caused by the activation of resistance monitor M1, which may be a built-in BM10 MEGGER device. The simultaneous activation of the monitor M1 and the switches S41 and S42 can be implemented with a three switch/two position device which includes switch S41, switch S42, and a third switch (not shown) in monitor M1 which connects monitor M1 to path 306' simultaneously with the opening of switch S42 and the closing of switch S41. Thus, when the monitor M1 is activated, a large voltage is-applied across nodes N1 and N5 in order to measure the resistance therebetween. With monitor M1 activated, switch S42 is open and current from the monitor M1 flows through a secondary current path comprising current path 322, resistor R5, path 322', path 324 (to ground), path 324', closed switch S41, current path 302 (which is connected to the conductive lattice of floor 10), path 304, and path 306 which is coupled to the other terminal of monitor M1. The current flow through monitor M1 is registered only if current paths 322, 322', 324, and 304 are all intact; thus the continuity of those current paths is tested by the embodiment shown in FIG. 14. In particular, an infinite resistance value is measured by the resistance monitor M1 if there is a discontinuity in the first lead wire or second lead wire.

In addition to testing the continuity of the current paths as explained above, the embodiment of the invention shown in FIGS. 13-14 also provides a test for determining whether the floor structure 10 is properly grounded. After the flooring structure 10 has been set to the desired resistance value by application of the external MEGGER 101 and adjustment of the variable resistor R6 as shown in FIG. 13, a series of resistance readings are taken on the resistance monitor Mi. When the flooring structure 10 is properly grounded (i.e., the flooring structure is coupled to ground only through the series combination of resistor R5 and resistor R6 which form the variable resistance), the internal resistance monitor M1, when activated, measures the resistance between node N1 and node N5, which as shown in FIG. 14 is approximately the resistance value of resistor R5. So long as the flooring structure 10 remains properly grounded, the resistance value seen by internal resistance monitor M1 should be the same, namely the value of resistor R5. However, if the flooring structure 10 is not properly grounded (i.e., the floor 10 is coupled to electrical ground through an improper, additional path), the internal resistance monitor M1 will be measuring the resistance of resistor R5 coupled in parallel with the resistance presented by the newly coupled flooring structure 10.

Because the resistance of the flooring structure 10 may be very large, internal resistance monitor M1 should have a large power supply so that the monitor is capable of reading large resistance values. If the flooring structure 10 picks up an improper, additional ground, the reading from the resistance monitor M1 will change, and any such change in the monitor reading, as compared to previous monitor measurements, provides ,an indication that the floor structure 10 has picked up a secondary ground and that corrective measures to restore the proper grounding of the floor need to be taken. Clearly, the detection of changes in the monitor measurements can be performed with mechanical or computer assistance, or can be manually taken.

Figure 15:
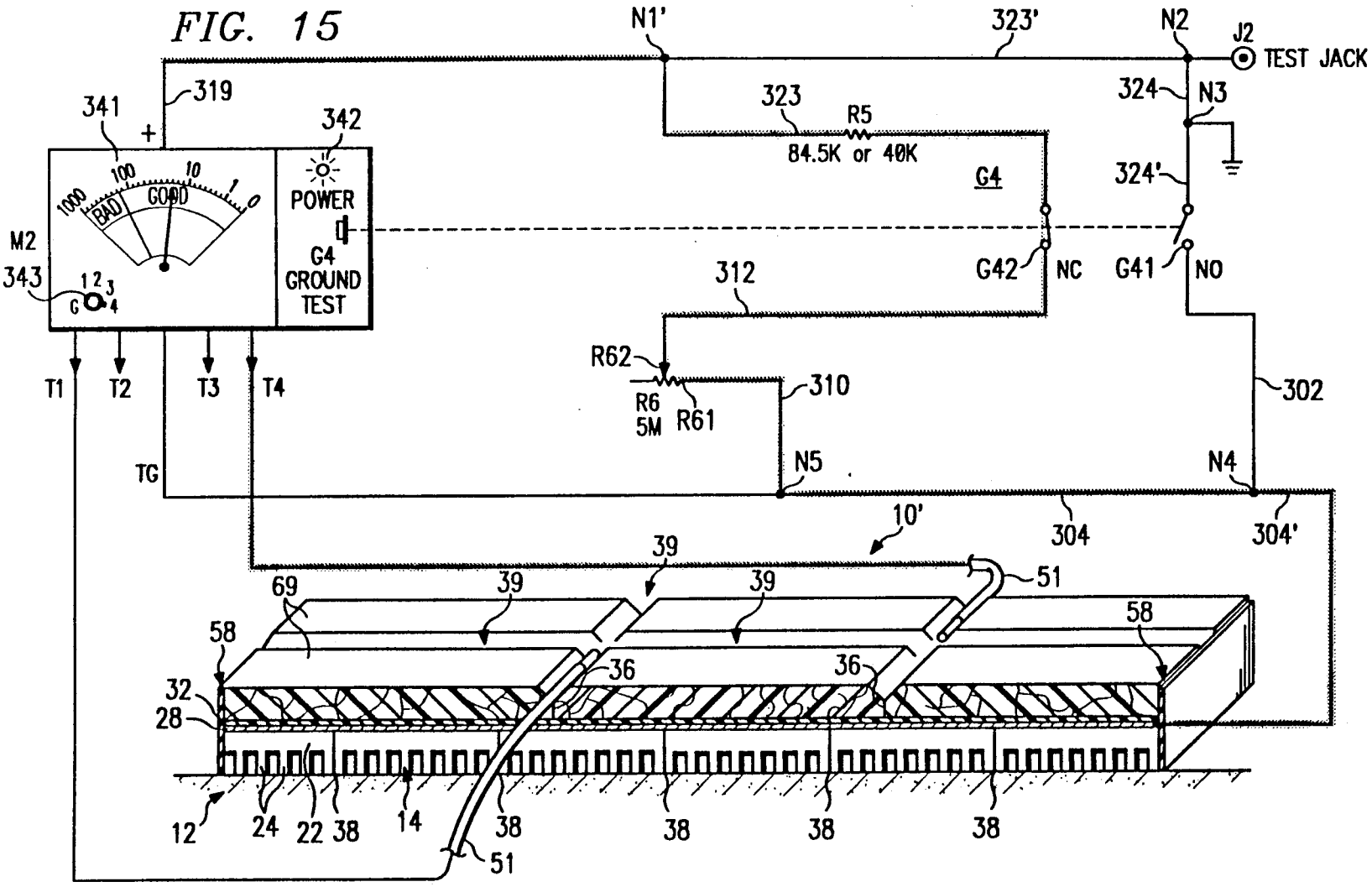
FIG. 15 is a schematic of an alternative embodiment showing a device and method for testing and/or setting the resistance between various points in the flooring structure 10 and ground.
Figure 16:
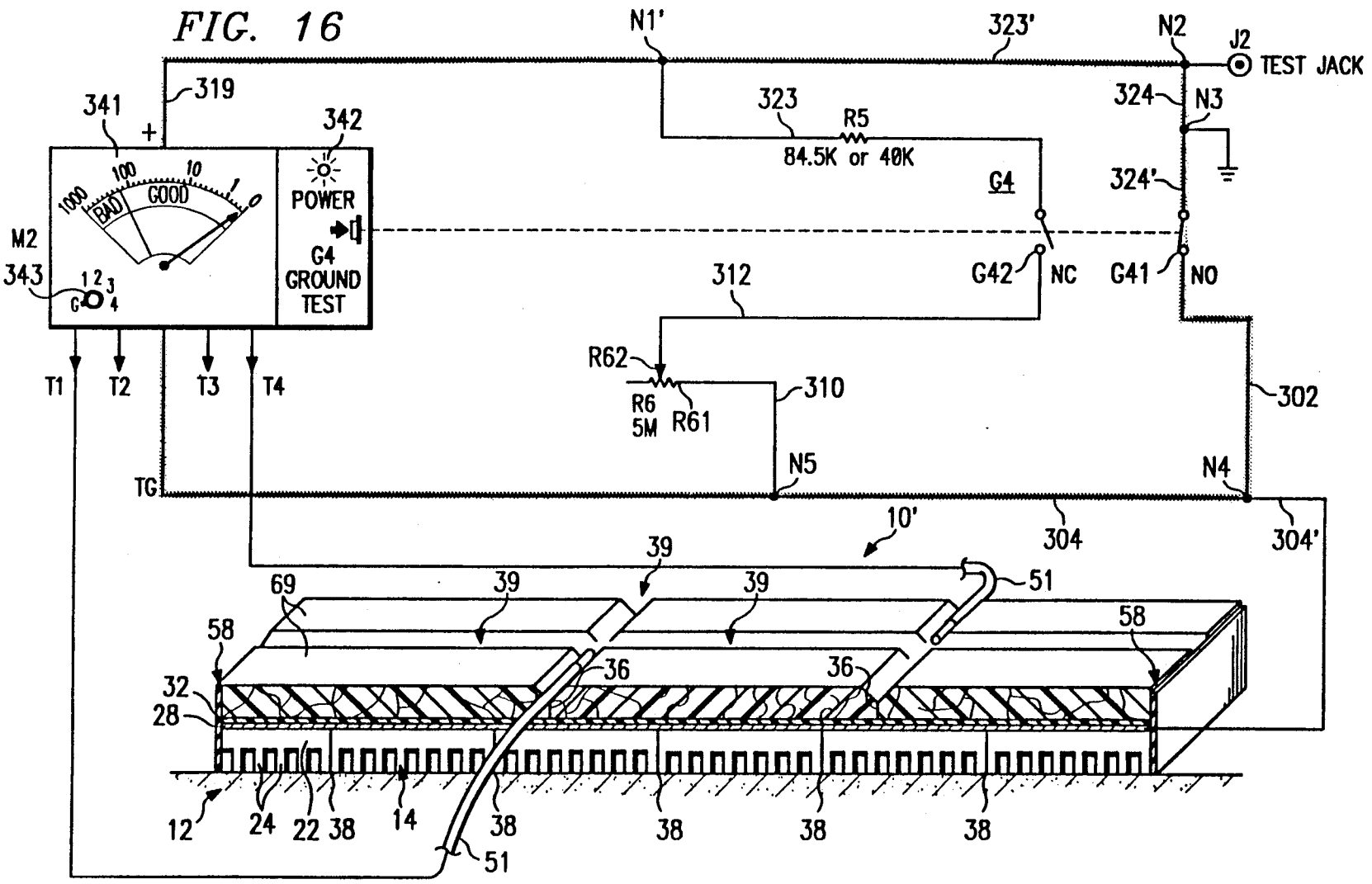
FIG. 16 is a schematic of the embodiment shown in FIG. 15 in an alternate state for testing the continuity of certain lead wires to the flooring structure.
Figure 17C:
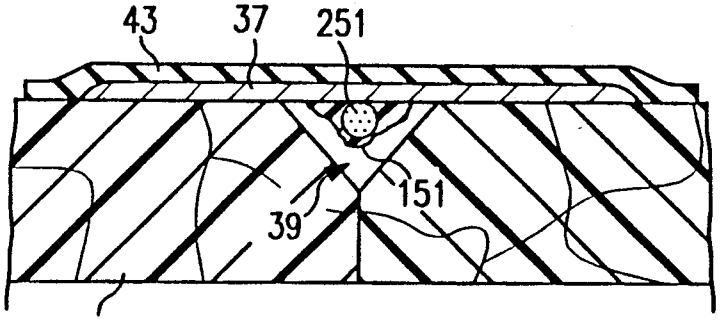
FIGS. 17*b* and 17*c* are cross section views of the two secondary terminals connected to the flooring structure as shown in FIG. 17*a*.
Figure 17B:
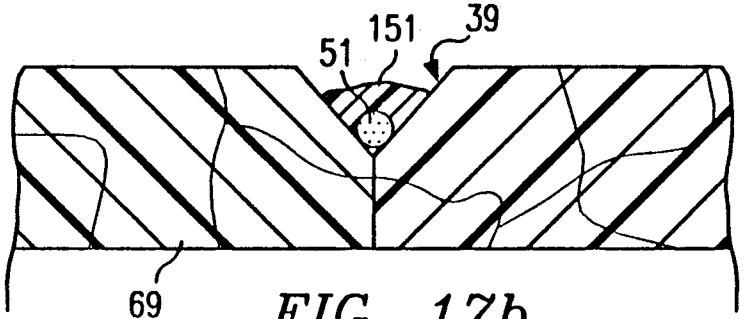

Referring now to FIGS. 15-17, a still further embodiment of the present invention is shown in which a resistance monitor is coupled across a variable resistance and further coupled through special lead wire contacts to a modified flooring structure so that at least an approximate measure of the overall resistance of the flooring structure and variable resistance can be measured, in addition to providing a means for testing the continuity of certain wires between the control box and flooring structure. In this embodiment, as seen in FIG. 15, resistance monitor M2 is coupled through its positive primary terminal 319 to node N1' which is connected between resistor R5 and current path 323'. In addition to the primary terminal, resistance monitor M2 comprises a display 341 for indicating the resistance value measured, a power switch 342 and a ground test switch G4. As can be seen from the drawing, switch G4 controls normally-closed switch G42 and normally-open switch G41. Resistance monitor M2 further comprises a secondary terminal which may include a plurality of negative terminal leads, TG, T1, T2, T3, T4, any one of which can be selected by selection switch 343. Secondary terminal TG from resistance monitor M2 is coupled to node N5 which is itself coupled through current paths 304 and 304' to conductive tape 28 in a modified flooring structure 10'. The modified flooring structure 10' comprises a moisture resistance member 22 having one side that is arranged in substantially planar orientation and supported by support members 24, an electrically conductive material 28 arranged in substantially planar orientation and contacting the moisture resistant member 22, and a specially formed semiconductive member 69 arranged in a substantially planar orientation and contacting the electrically conductive material 28. The specially formed semiconductive member 69 comprises a plurality of semiconductive tiles, each of which has a flat, horizontal top surface, vertical side surfaces, and tapered or angled surfaces (i.e., bevelled corner edges) joining the horizontal and vertical surfaces so that, when modified tiles 69 are joined together, a trough 39 is formed at the seam 36 by the bevelled edges.

The trough 39 is formed in the semiconductive tiles of the modified flooring structure 10' so that specially formed lead wires 51, which are coupled to the negative terminal(s) T1, T2, T3, T4 from resistance monitor M2, can be inserted into the troughs 39 and covered with sealant to permanently affix the specially formed wires 51 into place. As can be seen from FIG. 15, each specially formed wire 51 comprises an insulated conductor wire with the insulating material removed or stripped one-eighth of an inch from the end of the wire leaving an exposed-conductor that will be in electrical contact (i.e., epoxied) with the semiconductive material in the trough 39 of the semiconductor tiles 69 before the sealant is placed. The electrical contact between insulated conductor wire 51 and tile 69 form a sampling point on the flooring structure 10' which is used to define a current path along which monitor M2 takes a resistance measurement.

With the resistance monitor M2 coupled as shown in FIG. 16 to the conductive lattice material 28 through terminal TG or coupled as shown in FIG. 15 through terminals T1, T2, T3, T4 to various sampling points on the modified flooring structure 10', the embodiment of the present invention shown in FIGS. 15–16 works as follows. In normal operation, resistor monitor M2 is turned off, switch G41 is open and switch G42 is closed so that charges at the surface of the modified flooring structure 10' dissipate through the semiconductive tile member 69, into conductive lattice material 28, through current path 304', path 304, current path 310, variable resistor R6, current path 312, closed switch G42, current path 323, resistor R5, current path 323' and current path 324 to grounded node N3. Once the resistance monitor M2 is turned on, as shown in FIG. 15, the monitor M2 is prepared to take resistance readings across node N1' and whichever of the secondary terminals is selected with selection switch 343. For example, if terminal T4 is selected by switch 343, as shown in FIG. 15, the resistance value measured by monitor M2 will be the resistance seen between node N1' and the point on the flooring structure 10' where terminal T4 contacts the semiconductive tile through exposed wire portion of insulated conductor 51. In particular, the monitor M2 measures the resistance of the semiconductive tile 69, variable resistor R6 and resistor R5 (neglecting for the moment the resistance values of the lead wires, conductive lattice material 28 and conductive epoxy 32). The power source for the resistance monitor M2 should be sufficiently large so that a resistance reading can be obtained through the floor structure 10', but not so large that it presents a danger to persons walking on or otherwise contacting the floor structure 10'. It will be appreciated that selection switch 343 can be used to select other terminals so that alternative resistance sampling measurements can be taken all across the modified floor structure 10'. In this way, a reading of the overall resistance of the flooring structure 10' in combination with the variable resistance R6, R5 is obtained without the need for a separate, external measuring device.

An alternative embodiment of the ground continuity checking aspect of the present invention in shown in FIG. 16 wherein selection switch 343 has been moved so that terminal TG is selected and switch G4 has been activated so that switch G41 is closed and switch G42 is open. In this state, monitor M2 measures the resistance between node N1' and node N5 with current from the positive terminal of monitor M2 passing through node N1', current path 323', current path 324 (to ground), path 324', closed switch G41, current path 302 and path 304 to node N5. Because there are no resistance values in this current path (except for the negligible resistance of the lead wires and switches), the resistant monitor M2 should read a very low resistance unless one of the current paths 323', 324, 324', 302 or 304 has been broken. However, if there is a discontinuity in any of these paths, an infinite resistance value is measured by monitor M2. Again, this continuity test is important because leads 304 and 304', which comprise the second lead wire and connect the control box to the flooring structure 10', can be a very long wire subject to breakage. The same holds true for current paths 323' and 324 which form the first lead wire that Connects the control box to true electrical ground. Thus, as shown in FIG. 16, when both the power switch 342 and ground test switch G4 of resistance monitor M2 are activated, a low resistance reading around the indicated current path indicates that the paths are all intact.

Figure 17A:
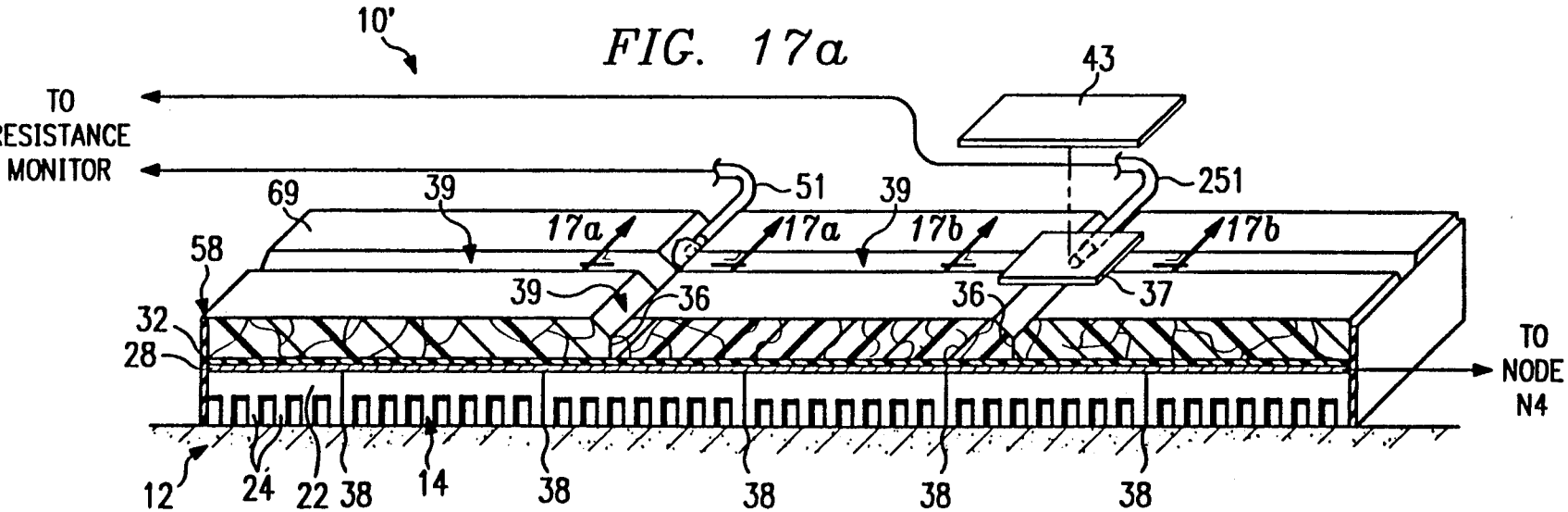
FIG. 17*a* is a detailed view of a modified flooring structure with two different types of secondary terminals attached to the semiconductive tiles for measuring the resistance from ground to the top of the flooring structure.

FIG. 17*a* shows in greater detail the modified flooring structure 10' with troughs 39 formed in the semiconductive tiles 69 and with secondary terminals T1, T2, T3, T4 attached to the tiles to form sampling points thereon. In particular, FIG. 17*a* shows an insulated conductor having an end portion stripped away to leave an exposed wire for affixation in the trough 39 via epoxy 151 as described above. FIG. 17*a* also shows an alternative secondary terminal which is formed by coupling an insulated conductor 251 to a planar contact pad 37 formed of conductive or metallic material. The contact pad 37 is electrically coupled to at least one of the secondary terminals T1, T2, T3, T4, via epoxy or welding or other suitable affixation means. The contact pad 37 and secondary terminal lead wire 251 are then placed as shown in FIG. 17*a* so that the wire 251 is positioned in the trough 39 and the contact pad 37 is placed over at least one of the tiles 34. The connection of the lead wire 251 to the contact pad 37 is best seen in FIG. 17*c*. The contact pad 37 is then electrically affixed to the tile 34 (i.e., by conductive epoxy) before the sealant is placed to fill the troughs 39. The contact pad 37 should be covered with an insulating layer 43 to prevent any contact between objects on the flooring structure and the contact pad, but the thickness of the contact pad 37 and its insulating layer 43 should be minimized so that the surface of the flooring structure is as even as possible.

By using the contact pad 37 to create a sampling point on the flooring structure, the resistance monitor M2, upon selection of the appropriate secondary terminal associated with the contact pad 37 with selection switch 343, measures the total resistance seen by an object on the flooring structure. As seen in FIG. 15, the total resistance is measured along the primary current path which is defined by path 323', resistor R5, closed switch G42, variable resistor R6, paths 304 and 304', conductive layer 28 and semiconductive tile(s) 34.

Figure 18:
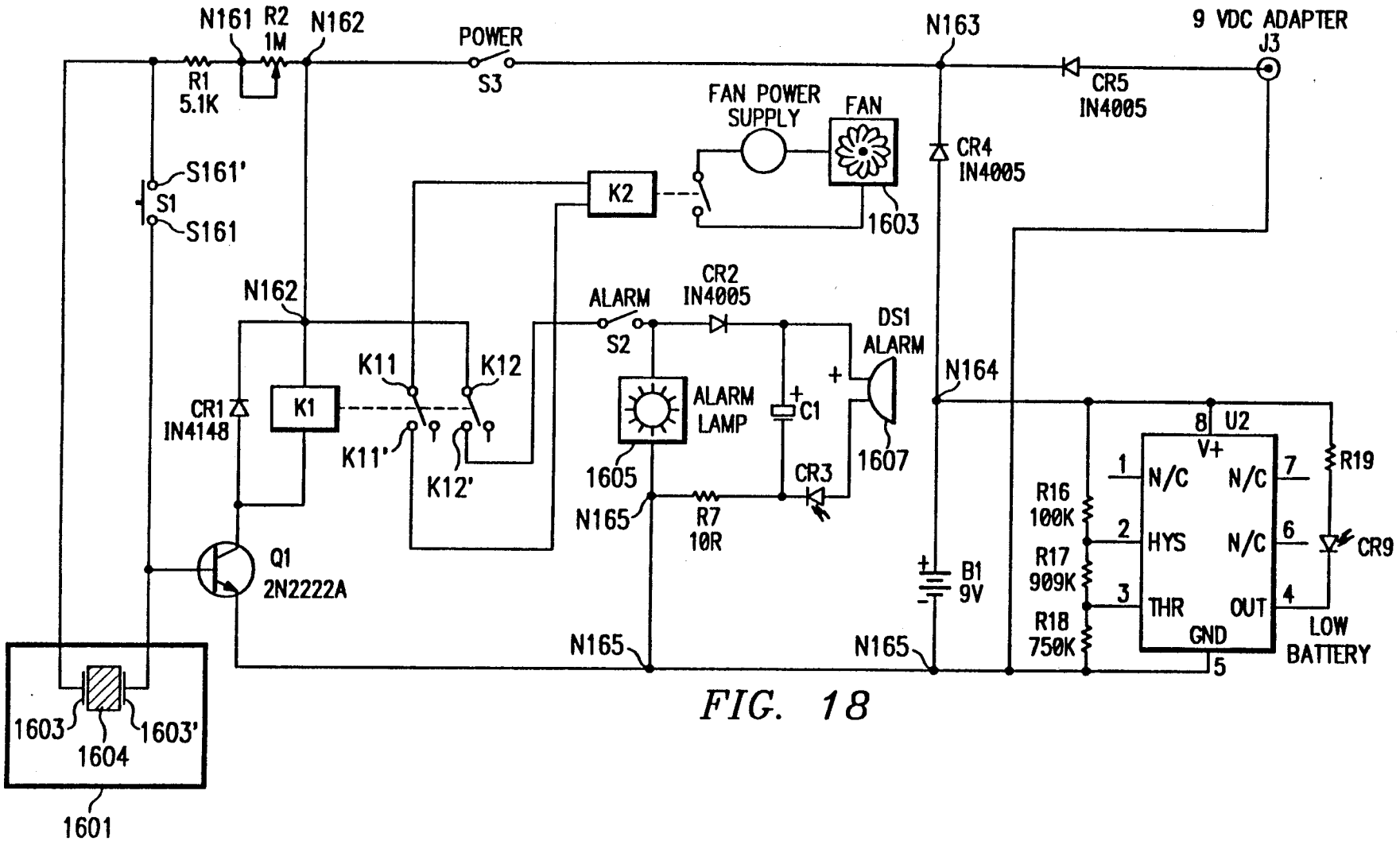
FIG. 18 is a schematic of an embodiment of the invention which may be used for moisture detection and drying.

Referring now to FIG. 18, an embodiment of a moisture sensing circuit and alarm is shown. In that embodiment, a moisture detector 1601 takes the form of conductive members 1603 and 1603' which are positioned around a moisture-variable resistive member 1604 (for example, a conductive foam material). As used herein, "moisture-variable resistive member" includes all materials whose resistance changes by some amount which is detectable when at least some part of the member is in the presence of moisture, or some other fluid. Other moisture detectors may be used with the circuit.

In the embodiment shown in FIG. 18, conductive member 1603' is connected to the base of transistor Q1 and terminal S161 of switch S1. Conductive member 1603 is connected to terminal S161' of switch S1 and to resistor R1. Resistor R1 is connected at node N161 to a variable resistor R2. Variable resistor R2 is connected at node 162 to the cathode of diode CR1, whose anode is connected to the collector of transistor Q1. Switch solenoid K1 is connected in parallel with diode CR1. Node N162 is connected through switch S3, when closed, to node N163. The cathode of diode CR4 is connected to node N163, and the anode of diode CR4 is connected to the positive terminal of battery B1, the negative terminal of which is connected to the emitter of transistor Q1 at node N165. Therefore, when switch S3 is closed, nine volts appears between node N162 and node N165. Accordingly, transistor Q1 is biased by resistors R1 and R2 through moisture detector 1601. When moisture detector 1601 is dry, it has a particular resistance value. If resistor R2 is set such that transistor Q1 is off when moisture detector 1601 is dry, switch K1 will be set such that there is no electrical connection between terminals K11 and K11', or between terminals K12 and K12'.

In the presence of moisture, the resistance of moisture detector 1601 will drop, and, assuming variable resistor R2 was set at the minimum resistance required for transistor Q1 to be off when moisture detector 1601 was dry, the decrease in resistivity of moisture detector 1601 will turn transistor Q1 on. When transistor Q1 turns on, current will flow through switch K1, causing an electrical connection across terminals K11 and K11', and across K12 and K12'. The connection created across terminals K11 and K11', will close switch K2, turning on fan 1603, which is a fan in a blower for drying moisture from underneath a flooring structure or system. The terminal connection made between terminals X12 and K12', assuming that the DS1 alarm has been enabled by closing switch S2, will turn on alarm lamp 1605 and sound alarm 1607.

Referring still to FIG. 18, a battery level detection circuit is shown as it is used to detect the value of the voltage in battery B1. Programmable voltage detector U2, in this embodiment, comprises a CMOS micropower voltage detector made such as that by Maxim Integrated Products, Sunnyvale, Calif. The programmable voltage detector is connected as follows. Pin 8 (V+) is connected to the positive terminal of battery B1 and resistor R16, which is connected between pin 8 and pin 2, the hysteresis resistor R17 is connected between the hysteresis pin 2 and threshold pin 3. Resistor R18 is connected between threshold pin 3 and ground pin 5 at node N165, and therefore to the negative terminal of battery B1. Output pin 4 of programmable voltage detector U2 is connected to the cathode of light emitting diode CR9. Resistor R19 is connected between pin 8 and the anode of light emitting diode CR9.

Also shown in FIG. 18, nine volt DC adapter J3 is shown connected between node N165 and the anode of diode CR5. The cathode of diode CR5 is connected to node N163. Nine volt DC adapter J3 is connected as shown for the purpose of optional 120 VAC power/12 VDC converter.

In practice, it has been noted that some devices which are placed on the surface of the -flooring structure have their own ground which is not isolated from the portion of those devices which contacts the floor. When such devices are used, their grounds provide a bypass around the variable resistor. Therefore, in some embodiments, a substantially non-conductive member, such as foot-pad should be placed between the semiconductive material 34 and grounded device. Examples of acceptable non-conductive materials include: Benelex #402 industrial laminate electrical insulation material, Waggoner Plastics, Grand Prairie, Tex. 75050, (214) 647-0500.

While the foregoing illustrates and discloses various embodiments of the invention, it is to be understood that many changes can be made in the composition of the flooring structure, the circuitry, and the application of a flooring structure or system as a matter of engineering choices without departing from the spirit and scope of the invention, as defined by the appended claims.

What is claimed is:

1. An electrostatic charge controlling structure for covering a base surface, comprising, in sequence:

a first layer of moisture resistant material;

a second layer of at least substantially rigid wood material;

a third layer of electrically conductive material; and a fourth layer of semiconductive member having electrical contact with said third layer.

2. An electrostatic charge controlling structure in accordance with claim 1 wherein:

said first layer comprises a moisture resistant member having one side that is arranged in a substantially planar orientation;

said third layer comprises an electrically conductive material arranged in a substantially planar orientation;

said second layer comprises a layer of substantially rigid wood material of substantially planar shape positioned between said one side of said moisture resistant member and said electrically conductive material; and said fourth layer comprises a semiconductive member arranged in a substantially planar orientation and in contact with said electrically conductive material.

3. An electrostatic charge controlling structure in accordance with claim 2 wherein said at least substantially rigid wood material has at least one edge comprising a tab and at least one other edge having a slot adapted to receive a tab.

4. An electrostatic charge controlling structure in accordance with claim 2 wherein said second layer comprises a plurality of pieces of at least substantially rigid wood material with each piece having at least two edges comprising a tab and at least two other edges comprising a slot adapted to receive a tab.

5. A moisture sensor comprising:

a moisture-variable resistive member whose resistance changes as a function of the level of moisture present in said moisture-variable resistive member;

a first conductive member and a second conductive member being positioned such that current can flow from one of said first and said second conductive members through said moisture-variable resistive member to the other of said first conductive member and said second conductive member, said first conductive member being connected to a power supply;

an output circuit;

a control circuit having an input and an output, said input of said control circuit being connected to said second conductive member, said output of said control circuit being connected to said output circuit such that said control circuit does not activate said output circuit when the level of moisture present in said moisture-variable resistive member is a low level but does activate said output circuit when the level of moisture present in said moisture-variable resistive member is a higher level.

6. A moisture sensor in accordance with claim 5 further comprising a variable resistance connected in series with said moisture-variable resistive member whereby said variable resistance can be adjusted to vary the level of moisture which has to be present in said moisture-variable resistive member in order for said control circuit to activate said output circuit.

7. A moisture sensor in accordance with claim 6 wherein said control circuit comprises a transistor having a base, an emitter and a collector, said base being connected to one of said first conductive member and said second conductive member as said input of said control circuit.

8. A moisture sensor in accordance with claim 7 wherein said output circuit is connected to one of the emitter and the collector of said transistor.

9. A moisture sensor in accordance with claim 8 wherein said output circuit comprises an alarm.

10. A moisture sensor in accordance with claim 8 wherein said output circuit comprises a circuit or controlling a moisture dryer.

11. A moisture sensor in accordance with claim 5 wherein said control circuit comprises a transistor having a base, an emitter and a collector, with the base being connected to one of said first conductive member and said second conductive member.

12. A moisture sensor in accordance with claim 11 wherein said output circuit is connected to one of the emitter and the collector of said transistor.

13. A moisture sensor in accordance with claim 5 wherein said output circuit comprises an alarm.

14. A moisture sensor in accordance with claim 5 wherein said output circuit comprises a circuit for controlling a moisture dryer.

15. A moisture sensor in accordance with claim 5 wherein said moisture-variable resistive member comprises a conductive foam material which has less resistance when it absorbs moisture.

16. A moisture detector circuit which detects moisture, comprising:

a conductive foam material which has less resistance when it absorbs moisture, said conductive foam material having first and second terminals;

a variable resistance having a first terminal connected to a node and a second terminal connected to said first terminal of said conductive foam material;

a transistor having a base and first and second terminals, said base being connected to said second terminal of said conductive foam material, said first terminal of said transistor being connected to an electrical ground, said second terminal of said transistor being connected to said node, said second terminal of said transistor being connected through said transistor to said electrical ground when a voltage is applied to said node and when the combined value of the resistance of the variable resistance and the resistance of the conductive foam material is low enough; and an output circuit connected between said node and said second terminal of said transistor, wherein said output circuit generates an output when there is a voltage between said node and said second terminal of said transistor.

17. A moisture detector circuit in accordance with claim 16 wherein said output circuit comprises an alarm circuit.

18. A moisture detector circuit in accordance with claim 16 wherein said output circuit comprises a moisture dryer circuit which activates a moisture dryer when there is a voltage between said node and second terminal of said transistor.

* * * * *